US009486054B2

(12) United States Patent
Tani

(10) Patent No.: US 9,486,054 B2
(45) Date of Patent: Nov. 8, 2016

(54) APPLYING MATERIAL EXTRUDING CONTAINER

(71) Applicant: TOKIWA CORPORATION, Gifu (JP)

(72) Inventor: Yoshikazu Tani, Saitama (JP)

(73) Assignee: TOKIWA CORPORATION, Gifu (JP)

( * ) Notice: Subject to any disclaimer, the term of this patent is extended or adjusted under 35 U.S.C. 154(b) by 64 days.

(21) Appl. No.: 14/330,252

(22) Filed: Jul. 14, 2014

(65) Prior Publication Data

US 2015/0030370 A1 Jan. 29, 2015

(30) Foreign Application Priority Data

Jul. 29, 2013 (JP) ..... 2013-156450

(51) Int. Cl.
*A45D 40/04* (2006.01)
*A45D 40/12* (2006.01)
*B43K 21/08* (2006.01)

(52) U.S. Cl.
CPC ..... *A45D 40/04* (2013.01); *A45D 40/12* (2013.01); *B43K 21/08* (2013.01)

(58) Field of Classification Search
CPC ..... A45D 40/04; A45D 40/06; A45D 40/12; A45D 2040/0025
USPC ..... 401/74, 75
See application file for complete search history.

(56) References Cited

U.S. PATENT DOCUMENTS

2004/0084343 A1 5/2004 An
2006/0222450 A1* 10/2006 Tani ..... A45D 34/04 401/266
2008/0237932 A1* 10/2008 Tani ..... A45D 34/042 264/334
2010/0104345 A1* 4/2010 Nasu ..... B65D 83/0011 401/75
2010/0104346 A1* 4/2010 Tani ..... A45D 40/04 401/68
2014/0334862 A1* 11/2014 Little ..... A45D 40/06 401/63

FOREIGN PATENT DOCUMENTS

| | | |
|---|---|---|
| JP | 2010-104522 | 5/2010 |
| JP | 2011-115485 | 6/2011 |
| KR | 2003-0015539 | 2/2003 |

OTHER PUBLICATIONS

U.S. Appl. No. 14/330,418, to Yoshikazu Tani, filed Jul. 14, 2014.
U.S. Appl. No. 14/330,570, to Yoshikazu Tani, filed Jul. 14, 2014.
Office Action issued in Korea Counterpart Patent Appl. No. 10-2014-0088422, dated Jul. 20, 2016, along with an English translation thereof.
China Official Action received in CN Application No. 201410328084.1, dated Aug. 23, 2016.

* cited by examiner

*Primary Examiner* — Mark A Laurenzi
*Assistant Examiner* — Bradley Oliver
(74) *Attorney, Agent, or Firm* — Greenblum & Bernstein, P.L.C.

(57) ABSTRACT

An applying material extruding container includes a movable body and a screw tube, and the movable body is moved forward by the screwing action of a screwing portion caused by the relative rotation of a filling member and a control tube in one direction. The screw tube includes a rear end tube portion, the control tube includes an internal tubular portion internally inserted into the rear end tube portion, on an outer circumferential surface of the internal tubular portion, a protrusion portion on one side that protrudes outwardly in a radial direction is provided, on an inner circumferential surface of the rear end tube portion, a protrusion on the other side that protrudes inwardly in the radial direction and that engages with the protrusion portion on one side in a rotation direction is provided and the protrusion on the other side has elasticity in the radial direction by cutouts therearound.

16 Claims, 27 Drawing Sheets

APPLYING MATERIAL EXTRUDING CONTAINER

TECHNICAL FIELD

The present invention relates to an applying material extruding container that extrudes and uses an applying material.

BACKGROUND ART

As a conventional applying material extruding container, for example, an applying material extruding container that is disclosed in patent document 1 is known. In the applying material extruding container disclosed in patent document 1, a main body tube (front portion of the container) and a control tube (rear portion of the container) are relatively rotated in one direction, and thus a screwing action of a screwing portion on a movable body and a screw part (screwing member) is produced, with the result that the movable body is moved forward.

CITATION LIST

Patent Literature

Patent document 1: Japanese Unexamined Patent Application Publication No. 2011-115485

SUMMARY OF THE INVENTION

Problems to be Solved by the Invention

Here, in recent years, it has been desired that in the applying material extruding container as described above, for example, though various requirements are made, a state where due to looseness, a gap and the like between members within the container, the members are unintentionally moved, that is, looseness, is reduced.

Hence, an object of the present invention is to provide an applying material extruding container that can reduce looseness.

Solutions to the Problems

To achieve the above object, according to the present invention, there is provided an applying material extruding container in which a movable body and a screwing member are provided in a container including a front portion of the container and a rear portion of the container, the front portion of the container and the rear portion of the container are relatively rotated in one direction such that screwing actions of screwing portions of the movable body and the screwing member act to move the movable body forward, where the screwing member includes a first tubular portion, the rear portion of the container includes a second tubular portion internally inserted into the first tubular portion, on an outer surface of the second tubular portion, a protrusion portion on one side that protrudes outwardly in a radial direction is provided, on an inner surface of the first tubular portion, a protrusion portion on the other side that protrudes inwardly in the radial direction and that engages with the protrusion portion on one side in a rotation direction is provided, at least one of the protrusion portion on one side and the protrusion portion on the other side has elasticity in the radial direction by cutouts formed therearound and in a state where the second tubular portion has not been internally inserted into the first tubular portion, an outside diameter of a top end portion of the protrusion on one side is larger than an inside diameter of the inner surface of the first tubular portion whereas in a state where the second tubular portion has been internally inserted into the first tubular portion, the protrusion on one side is constantly in contact with the inner surface of the first tubular portion or in the state where the second tubular portion has not been internally inserted into the first tubular portion, an inside diameter of a top end portion of the protrusion on the other side is smaller than an outside diameter of the outer surface of the second tubular portion whereas in the state where the second tubular portion has been internally inserted into the first tubular portion, the protrusion on the other side is constantly in contact with the outer surface of the second tubular portion.

In the applying material extruding container configured as described above, the second tubular portion is held by the first tubular portion, and a resistance can be constantly produced therebetween in the rotation direction, with the result that it is possible to reduce the looseness of the applying material extruding container.

According to the present invention, there is provided an applying material extruding container in which a movable body and a screwing member are provided in a container including a front portion of the container and a rear portion of the container, the front portion of the container and the rear portion of the container are relatively rotated in one direction such that screwing actions of screwing portions of the movable body and the screwing member act to move the movable body forward, where the screwing member includes a first tubular portion, the rear portion of the container includes a second tubular portion externally inserted into the first tubular portion, on an inner surface of the second tubular portion, a protrusion portion on one side that protrudes inwardly in a radial direction is provided, on an outer surface of the first tubular portion, a protrusion portion on the other side that protrudes outwardly in the radial direction and that engages with the protrusion portion on one side in a rotation direction is provided, at least one of the protrusion portion on one side and the protrusion portion on the other side has elasticity in the radial direction by cutouts formed therearound and in a state where the second tubular portion has not been externally inserted into the first tubular portion, an outside diameter of a top end portion of the protrusion on the other side is larger than an inside diameter of the inner surface of the second tubular portion whereas in a state where the second tubular portion has been externally inserted into the first tubular portion, the protrusion on the other side is constantly in contact with the inner surface of the second tubular portion or in the state where the second tubular portion has not been externally inserted into the first tubular portion, an inside diameter of a top end portion of the protrusion on one side is smaller than an outside diameter of the outer surface of the first tubular portion whereas in the state where the second tubular portion has been externally inserted into the first tubular portion, the protrusion on one side is constantly in contact with the outer surface of the first tubular portion.

In this applying material extruding container, the first tubular portion is held by the second tubular portion, and a resistance can be constantly produced therebetween in the rotation direction, with the result that in the present invention, it is also possible to reduce the looseness of the applying material extruding container.

Preferably, the protrusion on one side and the protrusion on the other side constitute a click mechanism that produces a click feeling as the front portion of the container and the rear portion of the container are relatively rotated. In this case, the protrusion on one side and the protrusion on the other side can be utilized as the click mechanism.

Preferably, the protrusion on one side and the protrusion on the other side constitute a ratchet mechanism that allows only the relative rotation of the front portion of the container and the rear portion of the container in one direction. In this case, the protrusion on one side and the protrusion on the other side can be utilized as the ratchet mechanism.

Preferably, the rear portion of the container is formed in a shape of a cylinder having a bottom, and in a bottom portion thereof, a plurality of opening portions arranged along a circumferential direction are provided, on an inner surface of the rear portion of the container, a plurality of protrusions are provided that protrude inwardly in the radial direction and that engage with the front portion of the container in an axial direction and the protrusions have a positional relationship in which the protrusions respectively cover the opening portions when seen in the axial direction. In this case, the opening portions are utilized, and thus it is possible to easily and preferably mold the rear portion of the container having a plurality of protrusions.

As a configuration that preferably achieves the action effects described above, specifically, the rear portion of the container may have an axial member extending along the axial direction, and the axial member may engage with the movable body in the rotation direction such that the rear portion of the container and the movable body are synchronously rotated.

Advantageous Effects of the Invention

According to the present invention, it is possible to provide an applying material extruding container that can reduce looseness.

DESCRIPTION OF EMBODIMENTS

Preferred embodiments of the present invention will be described in detail below with reference to drawing. In the following description, the same or corresponding elements are identified with the same symbols, and their description will not be repeated.

First Embodiment

Figure 1:
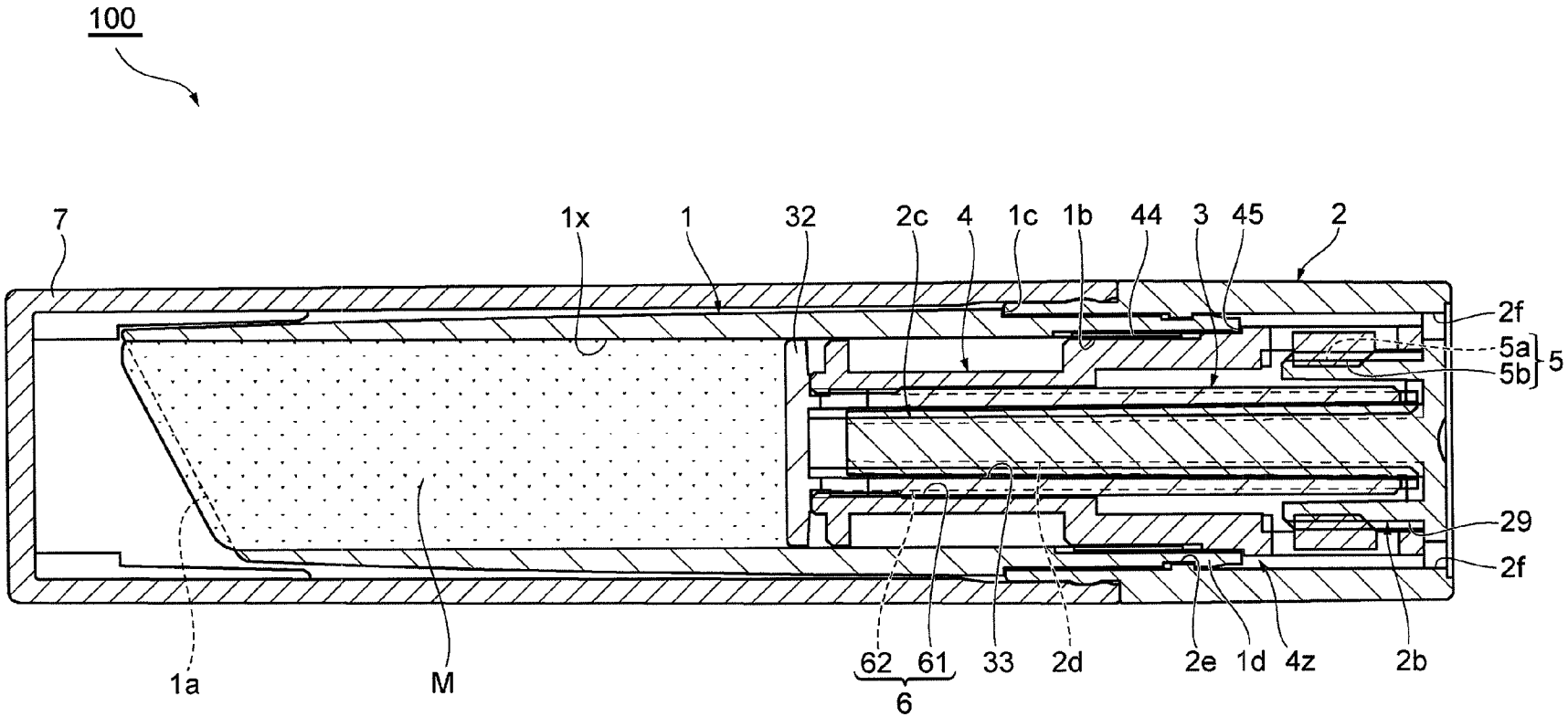
FIG. 1 is a vertical cross-sectional view showing an initial state of an applying material extruding container according to a first embodiment.
Figure 2:
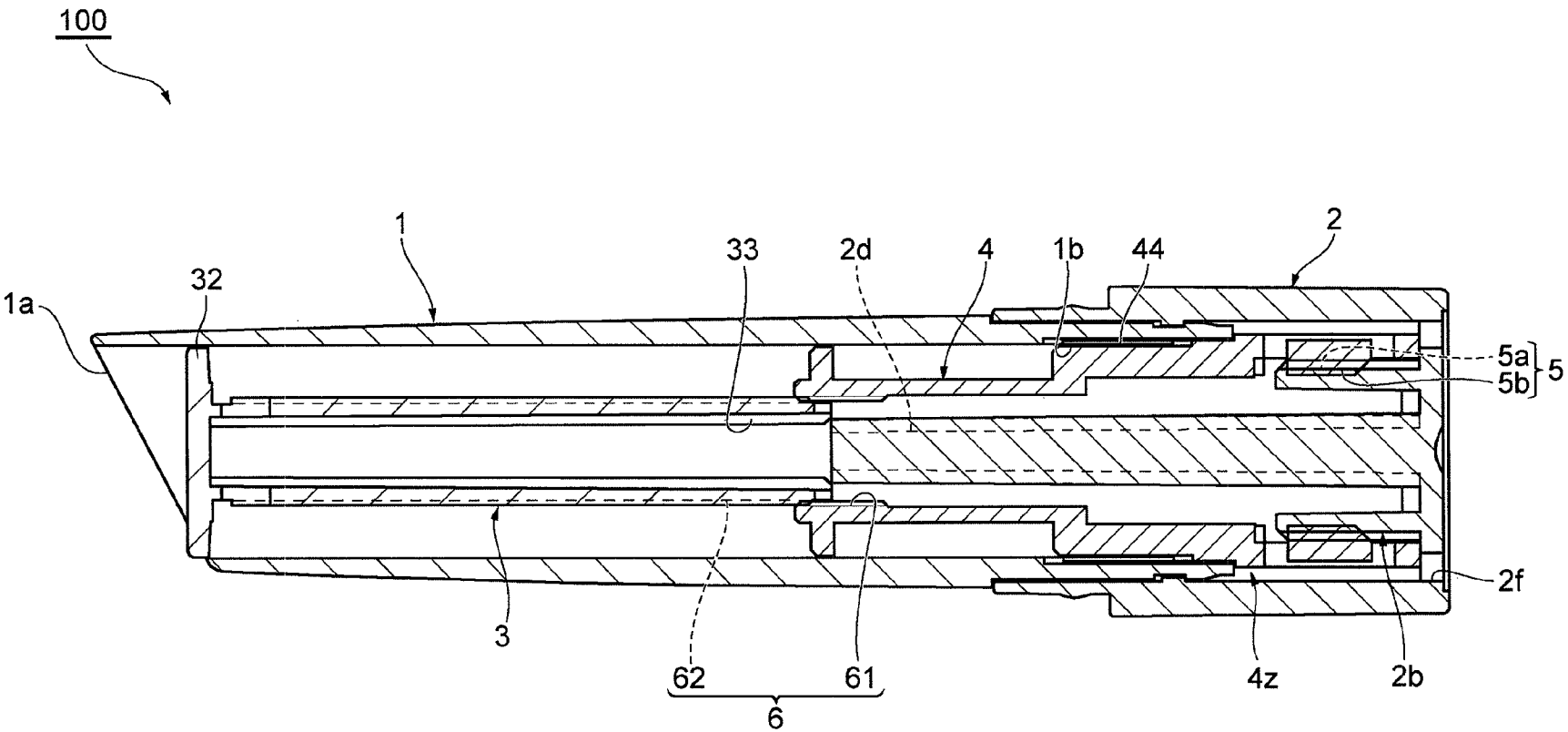
FIG. 2 is a vertical cross-sectional view showing a state of the forward limit of a movable body in the applying material extruding container of FIG. 1.

FIG. 1 shows a vertical cross-sectional view showing an initial state of an applying material extruding container according to a first embodiment, and FIG. 2 shows a vertical cross-sectional view showing a state of the forward limit of a movable body in the applying material extruding container of FIG. 1. As shown in FIGS. 1 and 2, in the applying material extruding container 100 of the present embodiment, an applying material M that fills its interior is discharged (extruded), as necessary, by an operation of a user.

As the applying material M, for example, the followings can be used: various rod-shaped cosmetic materials such as a lipstick, a lip gloss, an eyeliner, an eye-color, an eyebrow, a lip-liner, a cheek-color, a concealer, a cosmetic stick and a hair color; a rod-shaped core of a writing instrument or the like; and the like. In particular, rod-shaped members that are very soft (such as semisolid-shaped, soft solid-shaped, soft-shaped, jelly-shaped, mousse-shaped and paste-shaped with these contained) are preferably used. A rod-shaped member whose outside diameter is 1 mm or less or a thick rod-shaped member of 10 mm or more can be used.

As the applying material M, a semisolid-shaped member whose hardness is relatively low is preferably used, and an applying material M having a hardness of about 0.4 N to 0.9 N can be particularly preferably used. The hardness of the applying material M is determined from a general measuring method used for measuring hardness in cosmetics. Here, for example, FUDOH RHEO METER [RTC-2002D.D] (made by Rheotech Co., Ltd.) is used as a measuring device, and under conditions in which an ambient temperature is 25° C., a steel rod (adapter) of ϕ2 mm is inserted, at a speed of 6 cm/min, into the applying material M by a depth of about 10 mm, and then a force (strength) at peak produced in the applying material M at that time is assumed to be the hardness (the degree of needle insertion).

The applying material extruding container 100 includes, as an external configuration, a filling member 1 that has, therewithin a filling region 1*x* which is filled with the applying material M and that is a front tube and a control tube 2 that is relatively rotatable coupled, in an axial direction, to the rear end portion of the filling member 1. The filling member 1 constitute the front portion of the container, and the control tube 2 constitutes the rear portion of the container. The "axial" means the center line that extends forward and backward with respect to the applying material extruding container 100, and the "axial direction" means a direction along the axial in the forward and backward direction (the same is true for the following description). It is assumed that the direction in which the applying material M is fed out is a front (the direction of forward movement), and that the direction in which the applying material M is fed back is a rear (the direction of backward movement).

The applying material extruding container 100 includes, therewithin, the movable body 3 that is moved in the axial direction by the relative rotation of the filling member 1 and the control tube 2 and a screw tube 4 that serves as a screwing member to allow the movement of the movable body 3 by the relative rotation. As shown in FIG. 1, the applying material extruding container 100 includes a ratchet mechanism 5 that allows the relative rotation of the filling member 1 and the control tube 2 only in one direction, a screwing portion 6 that is provided in the movable body 3 and the screw tube 4 and a cap 7 that is removably fitted to the control tube 2 so as to cover the filling member 1 from the front side.

Figure 3:
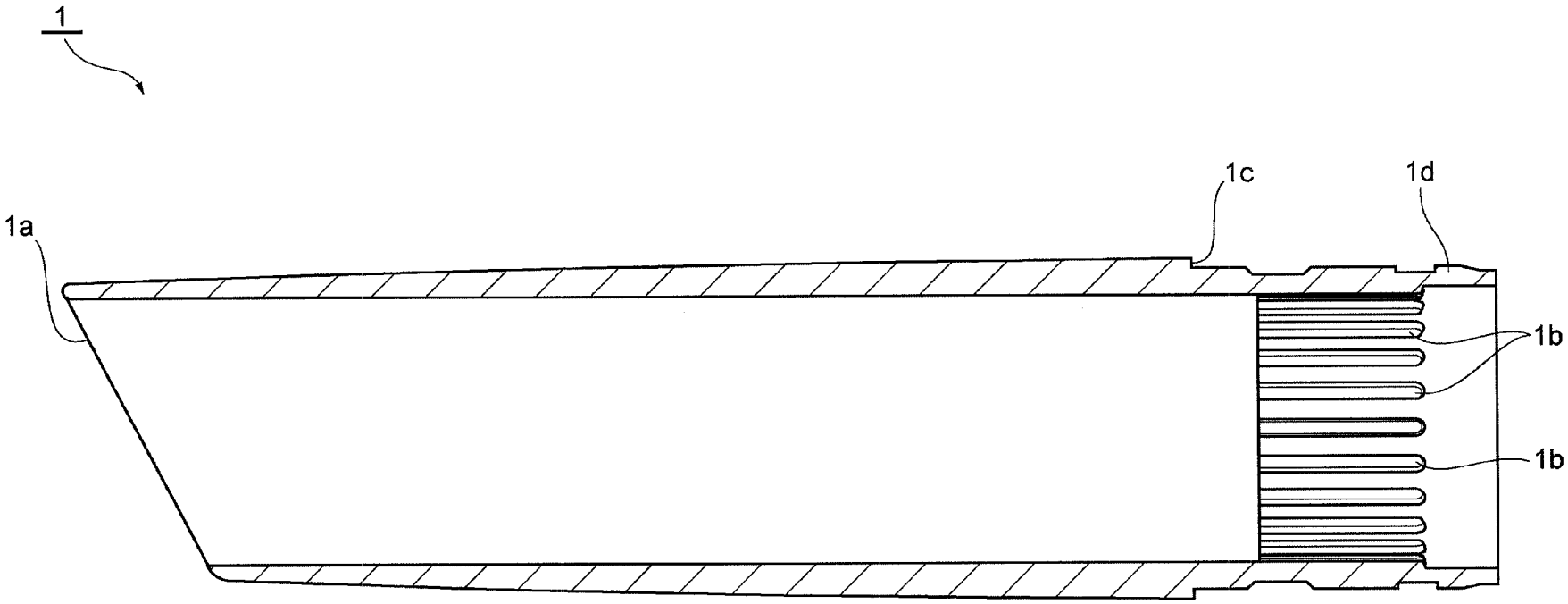
FIG. 3 is a cross-sectional view showing a filling member of the applying material extruding container of FIG. 1.

FIG. 3 is a cross-sectional view showing the filling member of the applying material extruding container of FIG. 1. As shown in FIGS. 1 and 3, the filling member 1 discharges, from a front end portion, the applying material M filling the internal filling region 1*x*, according to the operation of the user. The filling member 1 is molded of ABS resin, and is formed in the shape of a cylinder, and an opening portion 1*a* of its top end serves as a discharge port for feeding the applying material M. The opening portion 1*a* is formed with an inclination angle surface that is inclined at a predetermined angle with respect to the axial direction. The opening portion 1*a* may be formed in a flat shape formed with a vertical surface in the axial direction or may be formed in the shape of a mountain.

A rear portion side of the inner circumferential surface of the filling member 1 has, as a portion for engaging the screw tube 4 in a rotation direction (axial rotation direction), a knurl 1*b* in which a large number of recesses and projections are aligned in a circumferential direction and the recesses and projections extend in the axial direction by a predetermined length. The outer circumferential surface of the filling member 1 is formed as an inclination surface that is inclined to be tapered as the outer circumferential surface extends to the front side, and is brought close to and held by a rib 7*x* (which will be described later) within the cap 7 when the cap 7 is fitted. The rear portion side of the outer circumferential surface of the filling member 1 is decreased in diameter through a step 1*c*, and has a ring-shaped convex portion 1*d* that engages the control tube 2 in the axial direction.

Figure 4:
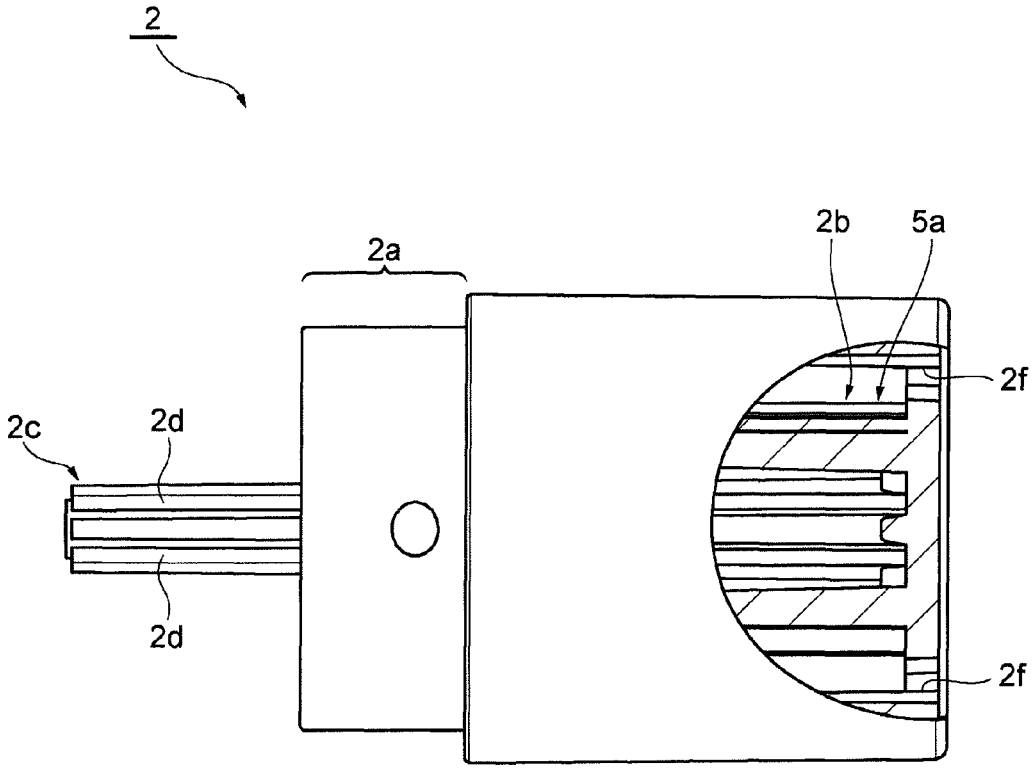
FIG. 4 is a side view showing a control tube of the applying material extruding container of FIG. 1 with its part shown as a cross section.
Figure 5:
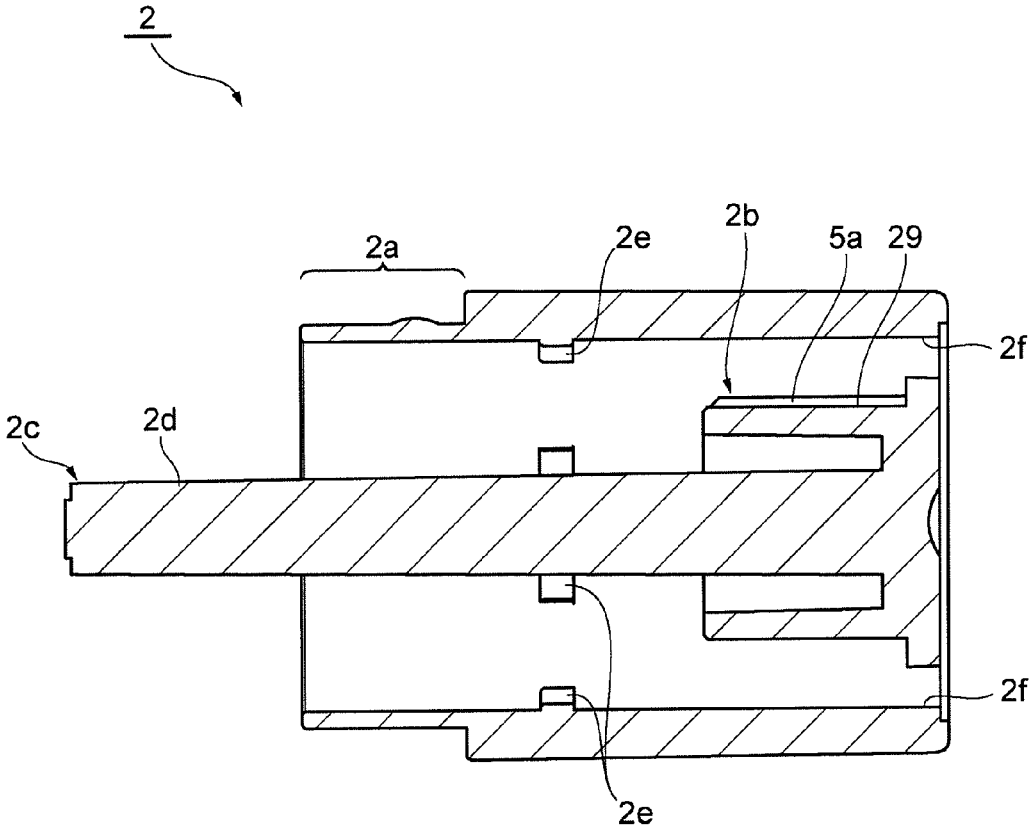
FIG. 5 is a cross-sectional view showing the control tube of FIG. 4.
Figure 6:
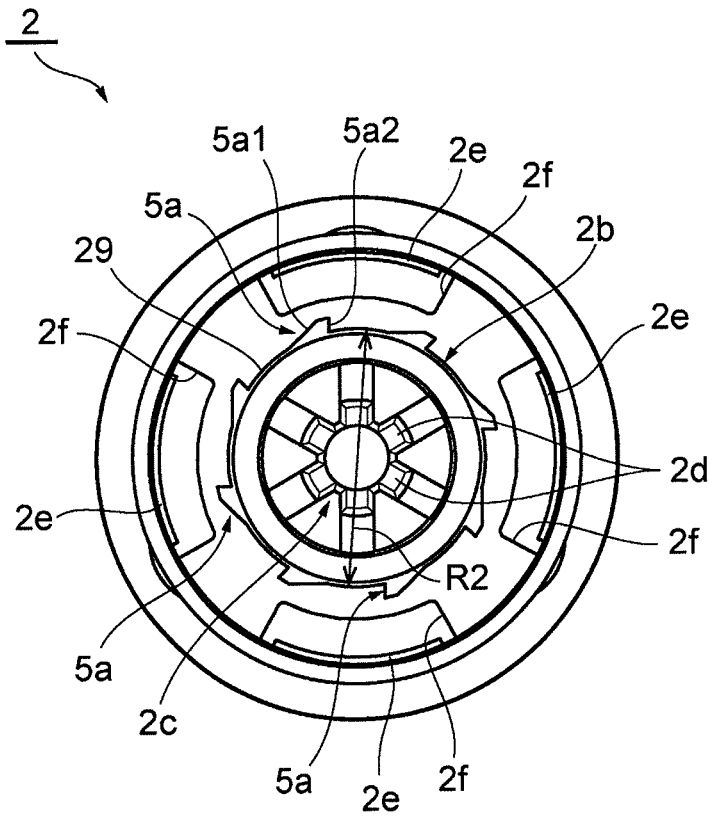
FIG. 6 is a front view showing the control tube of FIG. 4.
Figure 7:
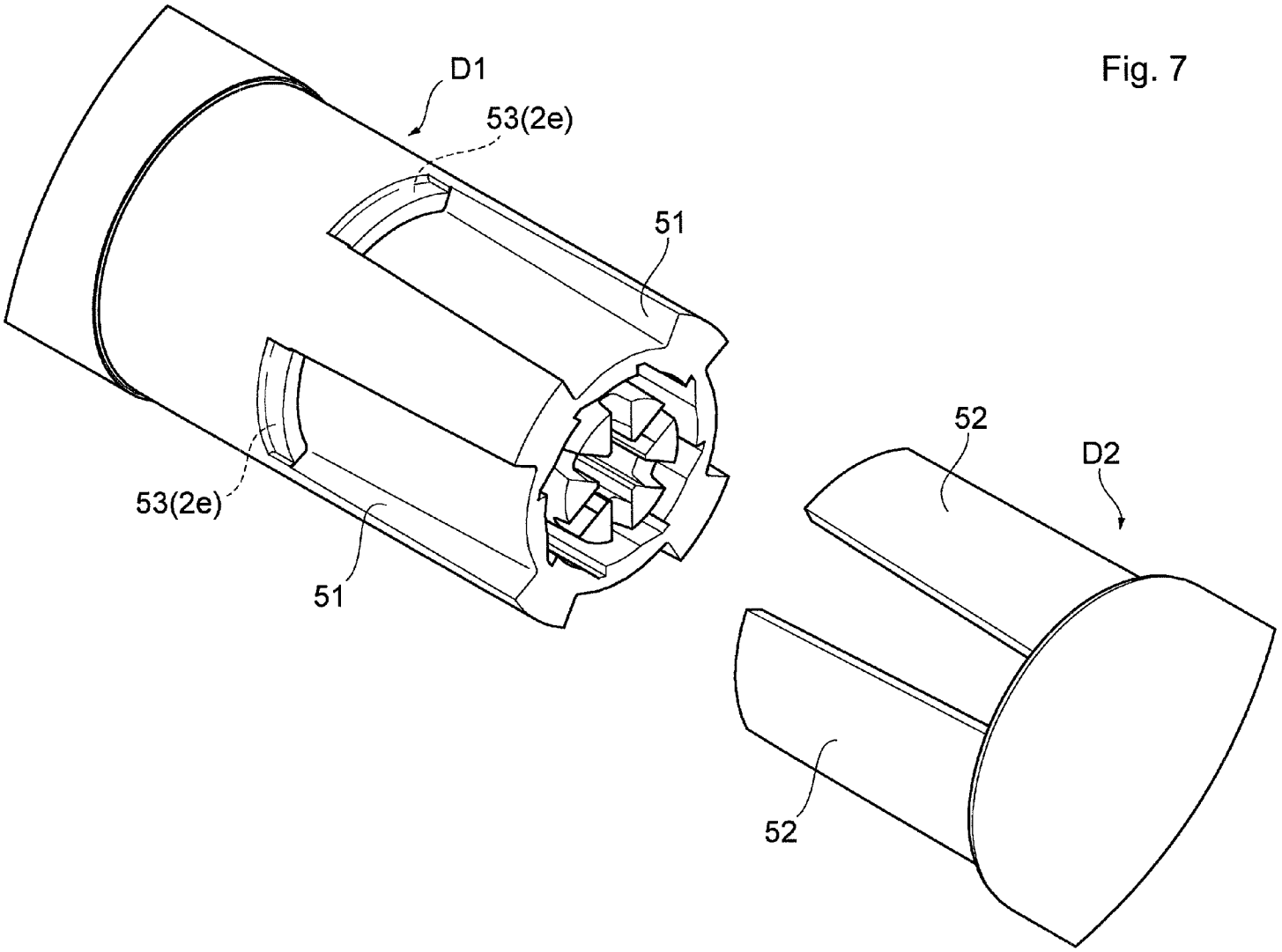
FIG. 7 is a perspective view illustrating the molding of the control tube of FIG. 4.

FIG. 4 is a side view showing the control tube of the applying material extruding container of FIG. 1 with its portion shown as a cross section, FIG. 5 is a cross-sectional view showing the control tube of FIG. 4, FIG. 6 is a front view showing the control tube of FIG. 4 and FIG. 7 is a perspective view illustrating the molding of the control tube of FIG. 4. As shown in FIGS. 4 to 6, the control tube 2 is an injection-molded product made of resin, and is formed in the shape of a cylinder that has an opening in the front and that has a bottom. The front end side of the control tube 2 has a front end tube portion 2*a* whose outside diameter is decreased. The cap C is removably and externally inserted into the front end tube portion 2*a*.

On the bottom portion within the control tube 2, an internal tubular portion (second tubular portion) 2*b* formed in the shape of a cylinder coaxial to the control tube 2 is provided so as to stand. On the outer circumferential surface 29 of the internal tubular portion 2*b*, a plurality of protrusion portions 5*a* on one side that constitute the ratchet teeth of the ratchet mechanism 5 are provided. The protrusion portions 5*a* on one side are provided so as to protrude outwardly in a radial direction at eight positions evenly spaced in the circumferential direction on the outer circumferential surface 29 of the internal tubular portion 2*b*. The protrusion portions 5*a* on one side here are provided so as to have a saw-tooth shape in the circumferential direction and extend along the axial direction.

On the center (axial position) of the bottom portion of the control tube 2, an axial member 2*c* that engages the movable body 3 in the rotation direction is provided so as to stand. The axial member 2*c* has, on the outer circumferential surface of a cylinder member, a plurality of protrusions 2*d* extending in the axial direction, the horizontal cross section (cross section perpendicular to the axial direction) thereof is formed in a non-circular shape and the protrusions 2*d* constitute one of rotation stop portions of the movable body 3.

In the center portion in the axial direction on the inner circumferential surface of the control tube 2, a plurality of projections 2*e* are provided that engage the ring-shaped convex portion 1*d* of the filling member 1 in the axial direction. The projections 2*e* are arranged in four positions evenly spaced in the circumferential direction, and protrude inwardly in the radial direction and extend along the circumferential direction. In the bottom portion of the control tube 2, a plurality of opening portions 2*f* is provided that penetrates the control tube 2 in the axial direction.

The opening portions 2*f* extend along the circumferential direction to form sectors, and are arranged in four positions corresponding to the projections 2*e* evenly spaced in the circumferential direction. Specifically, the opening portions 2*f* are formed in positions that include the projections 2*e* when seen in the axial direction. In other words, the projections 2*e* have a positional relationship in which the projections 2*e* cover the opening portions 2*f* when seen in the axial direction.

In the control tube 2, as shown in FIG. 1, the front end tube portion 2*a* is externally inserted into the filling member 1 to make contact with the step 1*c*, and the projections 2*e* engage the ring-shaped convex portion 1*d* of the filling member 1, with the result that the control tube 2 is coupled and fitted to the filling member 1 in the axial direction so that the control tube 2 can be relatively rotated with respect to the filling member 1.

As shown in FIGS. 5 and 7, the control tube 2 described above can be molded of resin with core pins D1 and D2. Here, since the control tube 2 has the opening portions 2*f*, the opening portions 2*f* are utilized, and thus it is possible to mold the projections 2*e* in a preferred manner.

For example, when the core pins D1 and D2 are combined with each other, predetermined spaces 53 corresponding to the projections 2*e* are provided, by concave portions 51 in the outer circumferential surface of the core pin D1 and column portions 52 in the core pin D2, in four positions evenly spaced in the circumferential direction such that they are sandwiched in the axial direction. Consequently, when a mold is released after the molding (that is, after the molten resin fills the predetermined spaces 53 and is solidified and then the projections 2*e* are formed), the core pin D2 can be made to slide in the axial direction such that the column portions 52 of the core pin D2 are removed through the opening portions 2*f*, and furthermore, when the product (control tube 2) is made to protrude and the mold is released, the core pin D1 can be easily removed by being made to slide in the axial direction.

Figure 8:
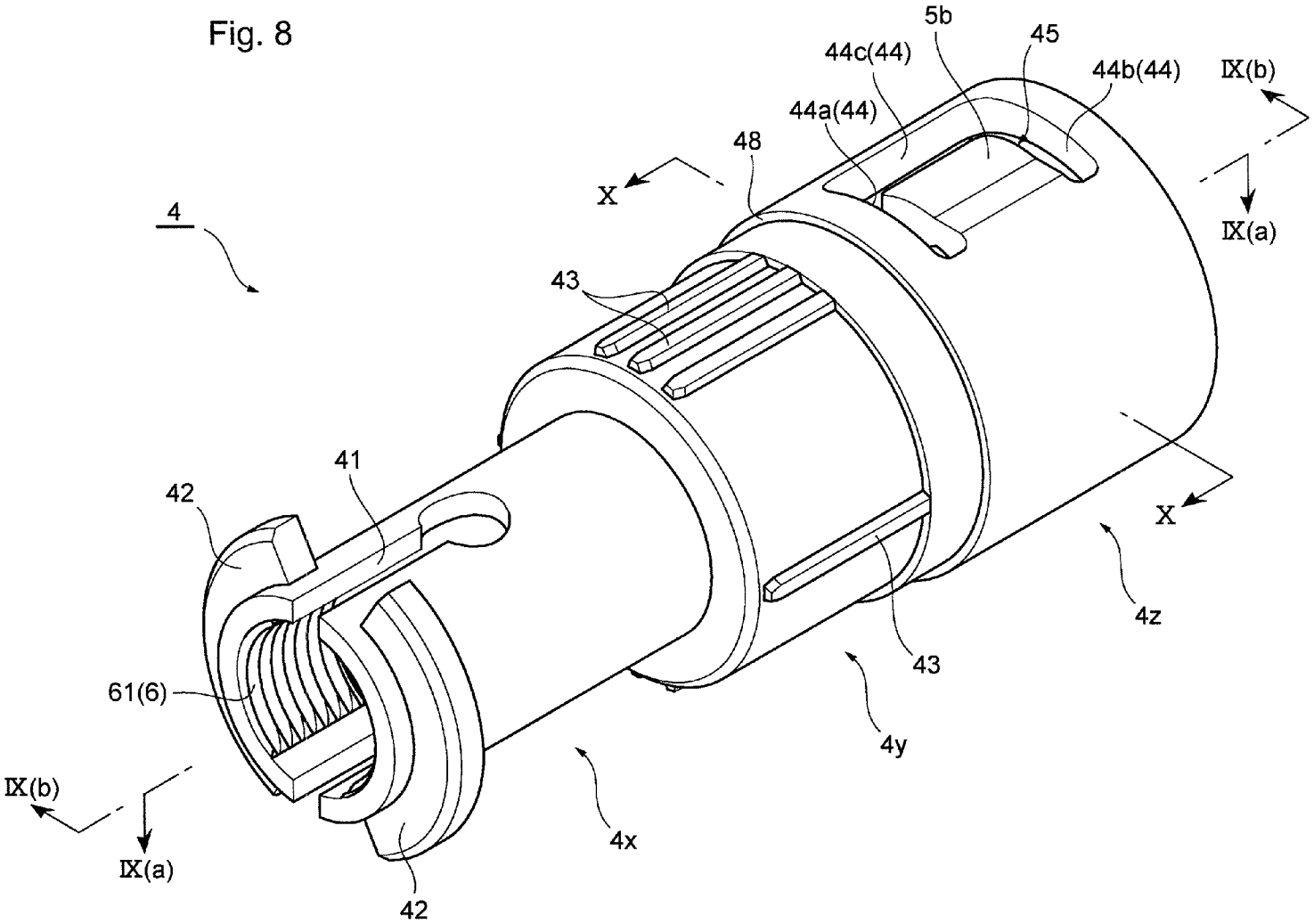
FIG. 8 is a perspective view showing the screw tube of the applying material extruding container of FIG. 1.
Figure 9:
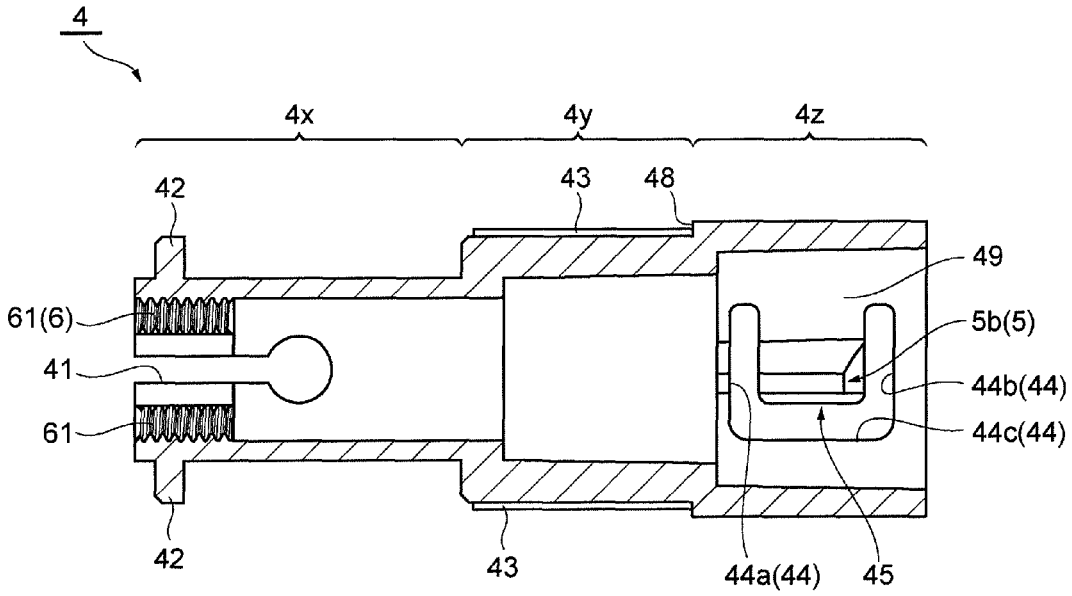
FIG. 9(*a*) is a cross-sectional view taken along line IX(a)-IX(a) of FIG. 8 and FIG. 9(*b*) is a cross-sectional view taken along line IX(b)-IX(b) of FIG. 8.
Figure 9:
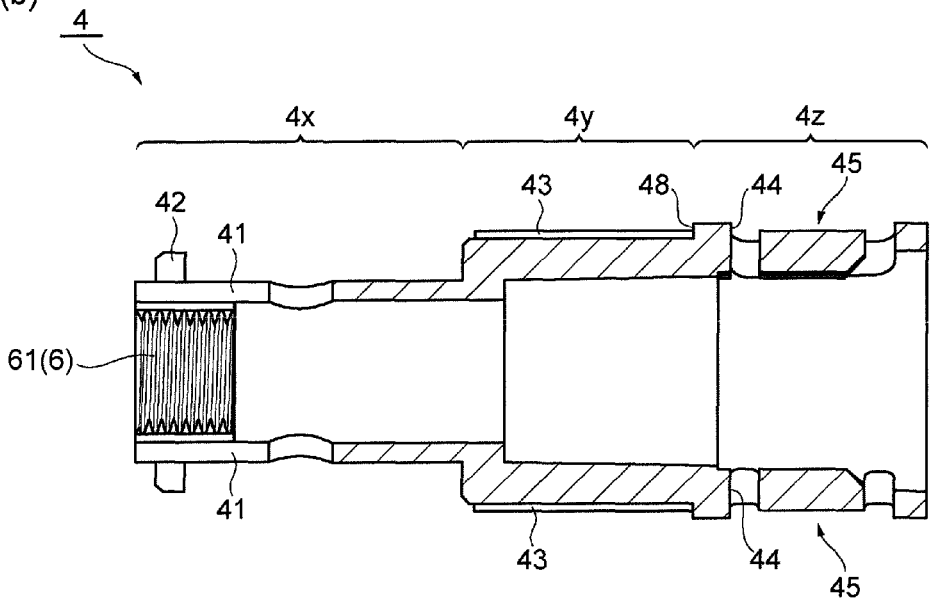
Figure 10:
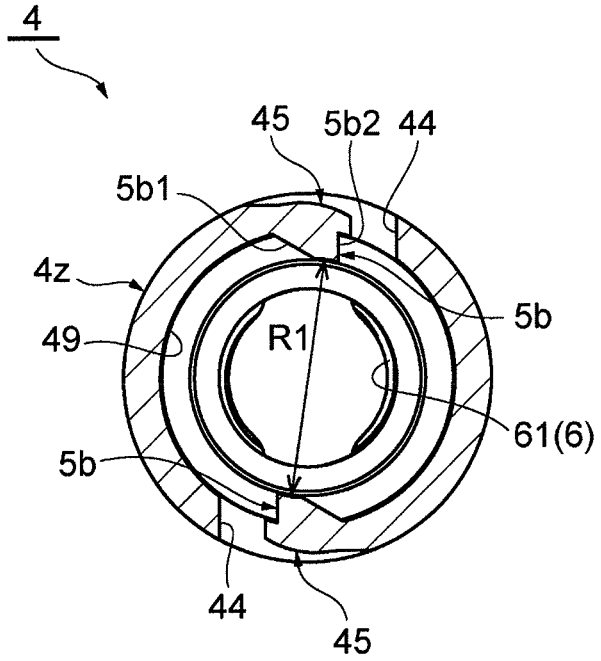
FIG. 10 is a cross-sectional view taken along line X-X of FIG. 8.

FIG. 8 is a perspective view showing the screw tube of the applying material extruding container of FIG. 1, FIGS. 9(*a*) and 9(*b*) are cross-sectional views taken along line IX(a)-IX(a) and line IX(b)-IX(b) of FIG. 8 and FIG. 10 is a cross-sectional view taken along line X-X of FIG. 8. As shown in FIGS. 8 to 10, the screw tube 4 is an injection-molded product made of resin, and is formed in the shape of a cylinder having a step. The screw tube 4 includes a front end tube portion 4*x*, a center tube portion 4*y* having an outer shape whose diameter is larger than that of the front end tube portion 4*x* and a rear end tube portion (first tubular portion) 4*z* having an outer shape whose diameter is larger than that of the center tube portion 4*y* in this order from the front to the rear. As the inner circumferential surface of the screw tube 4 extends from the front to the rear, the inside diameter thereof is increased in the shape of a step so as to follow the outside diameter.

The front end tube portion 4*x* extends from the front end in the axial direction by a predetermined length, and is configured such that the front end tube portion 4*x* can be expanded outwardly in the radial direction by slits 41 that are constituted as a pair so as to be opposite each other. The rear end side of the slits 41 is expanded so as to be circular when seen from the side (see FIG. 9), and thus the front end tube portion 4*x* is easily expanded so that the mold is easily released at the time of molding and the movable body 3 is easily assembled. In the inner circumferential surface of the front end tube portion 4*x*, a female screw 61 constituting the screwing portion 6 on one side is provided in a region ranging from the front end to a portion of predetermined length backward.

In the front side of the outer circumferential surface of the front end tube portion 4*x*, a pair of sector-shaped brim portions 42 is provided opposite each other through the slits 41. The brim portions 42 are close to or in contact with the inner circumferential surface of the filling member 1, and thus the inside diameter of the front end tube portion 4*x* and hence the female screw 61 is prevented from being increased, with the result that it is possible to acquire a force for driving the screwing portion 6 in the axial direction. In the center tube portion 4*y*, protrusions 43 for engaging the knurl 1*b* of the filling member 1 in the rotation direction are formed in a plurality of positions on the outer circumferential surface in the circumferential direction.

In the rear end tube portion 4*z*, in a pair of positions opposite each other in its inner circumferential surface 49, protrusion portions 5*b* on the other side that constitute the ratchet teeth of the ratchet mechanism 5 are provided. The protrusion portions 5*b* on the other side engage with the protrusion portions 5*a* on one side in the rotation direction, and are provided so as to protrude inwardly in the radial direction. In the rear end tube portion 4*z*, around the protrusion portions 5*b* on the other side, cutouts 44 which make the inside and the outside of the screw tube 4 communicate with each other and whose cross section is U-shaped are formed, and the protrusion portions 5*b* on the other side become elastic in the radial direction by the cutouts 44.

Specifically, the cutout 44 includes: a pair of slits 44*a* and 44*b* that are provided to be bored on both sides of the protrusion portion 5*b* on the other side in the rear end tube portion 4*z* in the axial direction and that extend in the circumferential direction; and a slit 44*c* that is provided to be bored on one side of the protrusion portion 5*b* on the other side in the rear end tube portion 4*z* in the circumferential direction and that extends along the axial direction so as to be continuous to the slits 44*a* and 44*b*. A wall portion surrounded by the cutouts 44 in the rear end tube portion 4*z* forms an arm 45 that is flexible in the radial direction, and thus the protrusion portion 5*b* on the other side arranged on the inner surface of the top end portion of the arm 45 has a predetermined elastic force (applying force) in the radial direction.

As shown in FIGS. 1 and 9, the screw tube 4 is internally inserted into the filling member 1, the protrusions 43 are engaged with knurl 1*b* of the filling member 1 in the rotation direction and the rear end surface of the filling member 1 makes contact with the step surface 48 of the center tube portion 4*y* and the rear end tube portion 4*z*, with the result that the screw tube 4 is synchronously rotatable engaged with and fitted to the filling member 1 in the axial direction. The screw tube 4 is internally inserted into the control tube 2, and the rear end tube portion 4*z* is externally inserted into the internal tubular portion 2*b*. Here, the rear end surface of the screw tube 4 is made to enter to the surrounding area (vicinity) of the bottom surface of the control tube 2, the protrusion portions 5*b* on the other side engage with the protrusion portions 5*a* on one side in the rotation direction and thus the ratchet mechanism 5 is formed.

Figure 11:
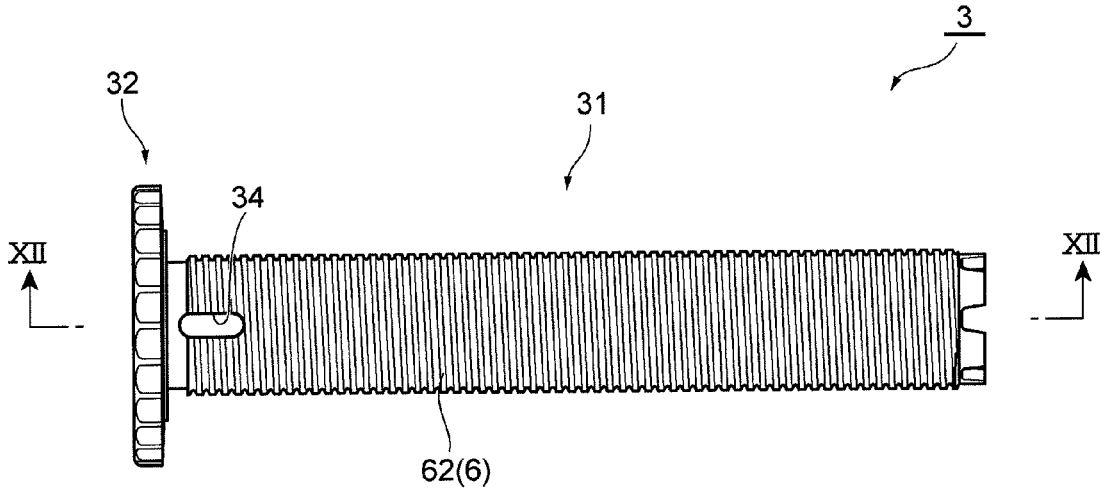
FIG. 11 is a side view showing the movable body of the applying material extruding container of FIG. 1.
Figure 12:
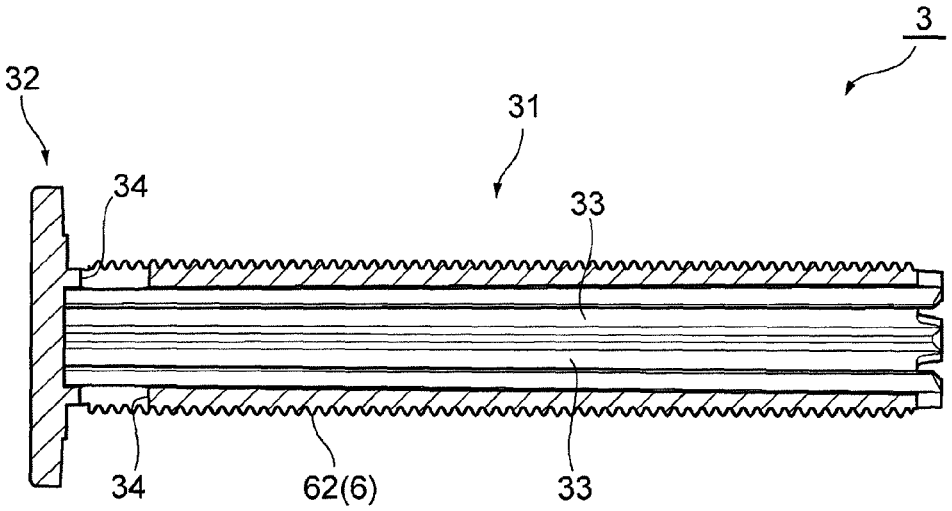
FIG. 12 is a cross-sectional view taken along line XII-XII of FIG. 11.

FIG. 11 is a side view showing the movable body of the applying material extruding container of FIG. 1, and FIG. 12 is a cross-sectional view taken along line XII-XII of FIG. 11. As shown in FIGS. 11 and 12, the movable body 3 is configured to include: a cylinder portion 31 that is constituted to be cylindrical; and an extruding portion 32 that is provided at the front end of the cylinder portion 31 to make intimate contact with the filling member 1 to constitute (form) the rear end of the filling region 1*x* (see FIG. 1).

In the cylinder portion 31, in the outer circumferential surface from the rear side of the front end portion to the rear end portion, a male screw 62 that constitutes the screwing portion 6 on the other side is provided. On the inner circumferential surface of the cylinder portion 31, in six positions evenly spaced in the circumferential direction, as the rotation stop portion on the other side, protrusions 33 protruding inwardly in the radial direction and extending in the axial direction are provided.

In a pair of positions opposite each other in the outer circumferential surface of the front end side of the cylinder portion 31, as portions for supporting the core pins such that the core pins are prevented from being inclined by an injection pressure at the time of molding, through-holes 34 having an oval cross section long in the axial direction are provided so as to penetrate from the inside to the outside. The external shape of the extruding portion 32 is formed in the shape of a flat cylinder, and its front end surface is formed in the shape of a flat surface perpendicular to the axial direction.

As shown in FIGS. 1 and 12, the extruding portion 32 of the movable body 3 is internally inserted so as to be close to the filling member 1, the cylinder portion 31 is externally inserted into the axial member 2*c* of the control tube 2 and is internally inserted into the screw tube 4 and the male screw 62 is screwed to the female screw 61 of the screw tube 4. The protrusions 33 engage between the protrusions 2*d* of the axial member 2*c* and engage with (that is, the cylinder portion 31 engages with the axial member 2*c* in the rotation direction such that the control tube 2 and the movable body 3 are synchronously rotated) and fitted to the control tube 2 in the rotation direction such that the protrusions 33 can be moved in the axial direction.

Figure 13:
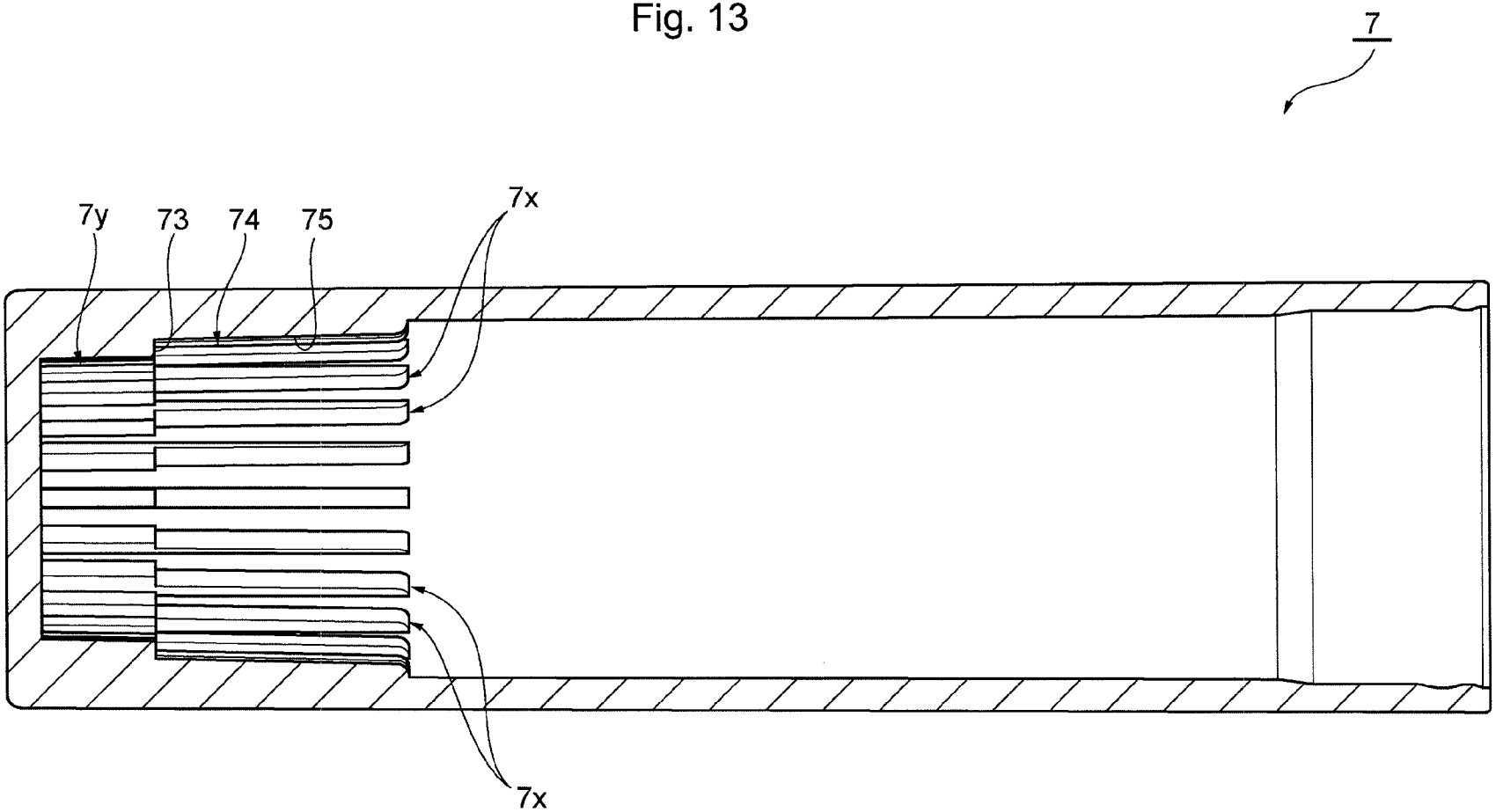
FIG. 13 is a cross-sectional view showing the cap of the applying material extruding container.

FIG. 13 is a cross-sectional view showing the cap of the applying material extruding container. As shown in FIG. 13, the cap 7 is cylindrical and has the bottom with the rear open, and in its inner circumferential surface, a plurality of ribs 7*x* extending in the axial direction are aligned along the circumferential direction. The rib 7*x* includes a raised portion 7*y* that is provided in the front end side and that is raised so as to protrude inwardly in the radial direction and an inclination portion 74 that is continuous to the rear of the raised portion 7*y* through a step 73. As the inclination portion 74 extends to the rear, its top surface 75 is inclined outwardly in the radial direction, and here, is inclined at an inclination angle corresponding to the outer circumferential surface of the filling member 1.

As shown in FIGS. 1 and 13, for example, in the initial state or at the time of no use, the cap 7 is externally inserted into the filling member 1 and the control tube 2, and is removably fitted integrally to the control tube 2. Here, the front end of the filling member 1 makes contact with the step 73 of the rib 7*x*, and the outer circumferential surface of the filling member 1 is brought close to the inclination portion 74 of the rib 7*x*, and thus the cap 7 can hold the filling member 1. With the cap 7, even when an external impact such as dropping is applied, the movement of the top end side of the filling member 1 and the movement in the lateral direction (direction perpendicular to the axial direction) can be reduced, and the disassembly and the breakage of the filling member 1 can be prevented, with the result that it is possible to protect the applying material M.

Here, in the present embodiment, as shown in FIGS. 6 and 10, in a state (state where the assembly has not been performed) where the internal tubular portion 2*b* of the control tube 2 is internally inserted into the rear end tube portion 4*z* of the screw tube 4, the inside diameter R1 of the top end portion of the protrusion portion 5*b* on the other side is less than that the outside diameter R2 of the outer circumferential surface 29 of the internal tubular portion 2*b*. For example, the inside diameter R1 is set less than the outside diameter R2 by a predetermined length, and the inside diameter R1 is set at ϕ 7.8 mm and the outside diameter R2 is set at 8.4 mm.

As shown in FIG. 1, in a state (state where the assembly has been performed) where the internal tubular portion 2*b* is internally inserted into the rear end tube portion 4*z*, the protrusion portions 5*b* on the other side are constantly brought into contact with the outer circumferential surface 29 of the internal tubular portion 2*b*. Hence, the internal tubular portion 2*b* of the control tube 2 is held by the rear end tube portion 4*z* of the screw tube 4, and a resistance is constantly produced therebetween in the rotation direction.

As described above, the protrusion portions 5*a* on one side and the protrusion portions 5*b* on the other side constitute the ratchet mechanism 5. Specifically, as shown in FIG. 6, in the protrusion portion 5*a* on one side, a side surface 5*a*1 on one side (the side that makes contact with the protrusion portion 5*b* on the other side when the filling member 1 and the control tube 2 are relatively rotated in one direction) in the circumferential direction is inclined with respect to the tangent plane of the outer circumferential surface 29 of the internal tubular portion 2*b* so as to be formed in the shape of a mountain. In the protrusion portion 5*a* on one side, a side surface 5*a*2 on the other side (the side that makes contact with the protrusion portion 5*b* on the other side when the filling member 1 and the control tube 2 are relatively rotated in the other direction) in the circumferential direction is constituted so as to be substantially perpendicular to the tangent plane of the outer circumferential surface 29 of the internal tubular portion 2*b*.

As shown in FIG. 10, in the protrusion portion 5*a* on the other side, a side surface 5*b*1 on the other side (the side that makes contact with the protrusion portion 5*a* on one side when the filling member 1 and the control tube 2 are relatively rotated in one direction) in the circumferential direction is inclined with respect to the tangent plane of the inner circumferential surface 49 of the rear end tube portion 4*z* so as to be formed in the shape of a mountain. In the protrusion portion 5*b* on the other side, a side surface 5*b*2 on one side (the side that makes contact with the protrusion portion 5*a* on one side when the filling member 1 and the control tube 2 are relatively rotated in the other direction) in the circumferential direction is constituted so as to be substantially perpendicular to the tangent plane of the inner circumferential surface 49 of the rear end tube portion 4*z*.

In the applying material extruding container 100 in the initial state configured as described above and shown in FIG. 1, when the cap 7 is removed by the user, and the filling member 1 and the control tube 2 are relatively rotated in one direction which is the feeding-out direction, the screwing portion 6 consisting of the female screw 61 of the screw tube 4 and the male screw 62 of the movable body 3 and the rotation stop portion consisting of the protrusions 2*d* of the control tube 2 and the protrusions 33 of the movable body 3 work together, thus the movable body 3 is moved forward and the applying material M filling the filling region 1*x* of the filling member 1 is discharged through the opening portion 1*a* (see FIG. 2).

At the time of the relative rotation described above, the protrusion portions 5*a* on one side and the protrusion portions 5*b* on the other side in the ratchet mechanism 5 engage with each other in the radial direction, and the protrusion portions 5*b* on the other side receive a force acting inwardly in the radial direction by the elastic force in the radial direction produced by the cutouts 44 (see FIG. 8), with the result that the engagement and the disengagement (meshing and meshing cancellation) of the protrusion portions 5*a* on one side and the protrusion portions 5*b* on the other side are repeated.

In other words, the side surface 5*a*1 (see FIG. 6) of the protrusion portions 5*a* on one side engages with the side surface 5*b*1 (see FIG. 10) of the protrusion portions 5*b* on the other side in the rotation direction, and they slide so as to rise up. Then, the protrusion portions 5*a* on one side are moved over the protrusion portions 5*b* on the other side to cancel the engagement, and thereafter the engagement is performed again in the rotation direction. Consequently, each time the protrusion portions 5*a* on one side and the protrusion portions 5*b* on the other side engage and disengage with each other, a click feeling is provided to the user.

On the other hand, even when the filling member 1 and the control tube 2 are relatively rotated in the other direction, which is the feeding-back direction, the side surface 5*a*2 (see FIG. 6) of the protrusion portions 5*a* on one side make contact with the side surface 5*b*2 (see FIG. 10) of the protrusion portions 5*b* on the other side, and thus they are locked in the rotation direction, with the result that the relative rotation is regulated such that the screw tube 4 and the control tube 2 are not relatively rotated. Consequently, the filling member 1 and the control tube 2 are not rotated in the other direction (the rotation can be prevented by a rotation force (torque) equal to or less than the setting).

As described above, in the present embodiment, in the state where the internal tubular portion 2*b* of the control tube 2 has not been internally inserted into the rear end tube portion 4*z* of the screw tube 4, the inside diameter R1 of the top end portion of the protrusion portion 5*b* on the other side in the rear end tube portion 4*z* is less than the outside diameter R2 of the outer circumferential surface 29 of the internal tubular portion 2*b*. As shown in FIG. 1, in the state where the internal tubular portion 2*b* is internally inserted into the rear end tube portion 4*z*, when the filling member 1 and the control tube 2 are relatively rotated, the protrusion portions 5*b* on the other side having an elastic force in the radial direction is made to constantly engage with the protrusion portions 5*a* on one side in the rotation direction, and is constantly brought into contact with the outer circumferential surface 29 of the internal tubular portion 2*b*.

Hence, in the present embodiment, without increasing the number of components, it is possible to constantly bring the protrusion portions 5*b* on the other side into contact with the protrusion portions 5*a* on one side and the surrounding area thereof, with the result that it is possible to constantly produce a resistance in the rotation direction. In other words, the internal tubular portion 2*b* (control tube 2) is held by the rear end tube portion 4*z* (screw tube 4), and a resistance can be constantly produced therebetween in the rotation direction, with the result that it is possible to reduce the looseness of the applying material extruding container 100.

Moreover, in the present embodiment, as described above, when the filling member 1 and the control tube 2 are relatively rotated in one direction to move forward the applying material M, each time the protrusion portions 5*a* on one side and the protrusion portions 5*b* on the other side engage and disengage, a click feeling can be provided. In this way, the protrusion portions 5*a* on one side and the protrusion portions 5*b* on the other side can also be used as a clicking mechanism for detecting the forward movement of the applying material M.

Furthermore, in the present embodiment, as described above, the protrusion portions 5*a* on one side and the protrusion portions 5*b* on the other side can be utilized as the ratchet mechanism 5 that allows only the relative rotation of the filling member 1 and the control tube 2 in one direction.

Moreover, in the present invention, as described above, since the control tube 2 has the opening portions 2*f*, as described above, when the control tube 2 has a plurality of projections 2*e* is molded, the portions corresponding to the opening portions 2*f* are utilized, and thus it is possible to perform resin molding in which the core pins D1 and D2 can be removed in the axial direction. In other words, a plurality of opening portions 2*f* is utilized, and thus it is possible to easily and preferably mold the control tube 2 having the projections 2*e*.

Moreover, although in the present embodiment, a pair of protrusion portions 5*b* on the other side are formed in two places by being rotated 180° and copied, the protrusion portions 5*b* on the other side may be formed in three places or a large number of places by being rotated and copied or the protrusion portion 5*b* on the other side may be formed in one place. When the protrusion portion 5*b* on the other side is formed in one place, the inside diameter R1 is a diameter that passes through the fop end portion of the protrusion portion 5*b* on the other side with the axial in the center.

Moreover, in the present embodiment, as described above, when the cap 7 is attached, the filling member 1 can be held by the rib 7*x* of the cap 7, and thus it is possible to further reduce the looseness of the applying material extruding container 100 at the time of no use.

Incidentally, in the present embodiment, in the state where the internal tubular portion 2*b* of the second tubular portion has not been internally inserted into the rear end tube portion 4*z* of the first tubular portion, the outside diameter of the top end portion of the protrusion portion 5*a* on one side may be more than the inside diameter of the inner circumferential surface 49 of the rear end tube portion 4*z* whereas in the state where the internal tubular portion 2*b* is internally inserted into the rear end tube portion 4*z*, the protrusion portion 5*a* on one side may be constantly brought into contact with the inner circumferential surface 49.

Although in the present embodiment, as described above, the cutouts 44 are formed around the protrusion portions 5*b* on the other side in the rear end tube portion 4*z* to provide an elastic force to the protrusion portions 5*b* on the other side, either instead of or in addition to this, the cutouts may be formed around the protrusion portions 5*a* on one side in the internal tubular portion 2*b* to provide an elastic force to the protrusion portions 5*a* on one side.

Second Embodiment

Figure 14:
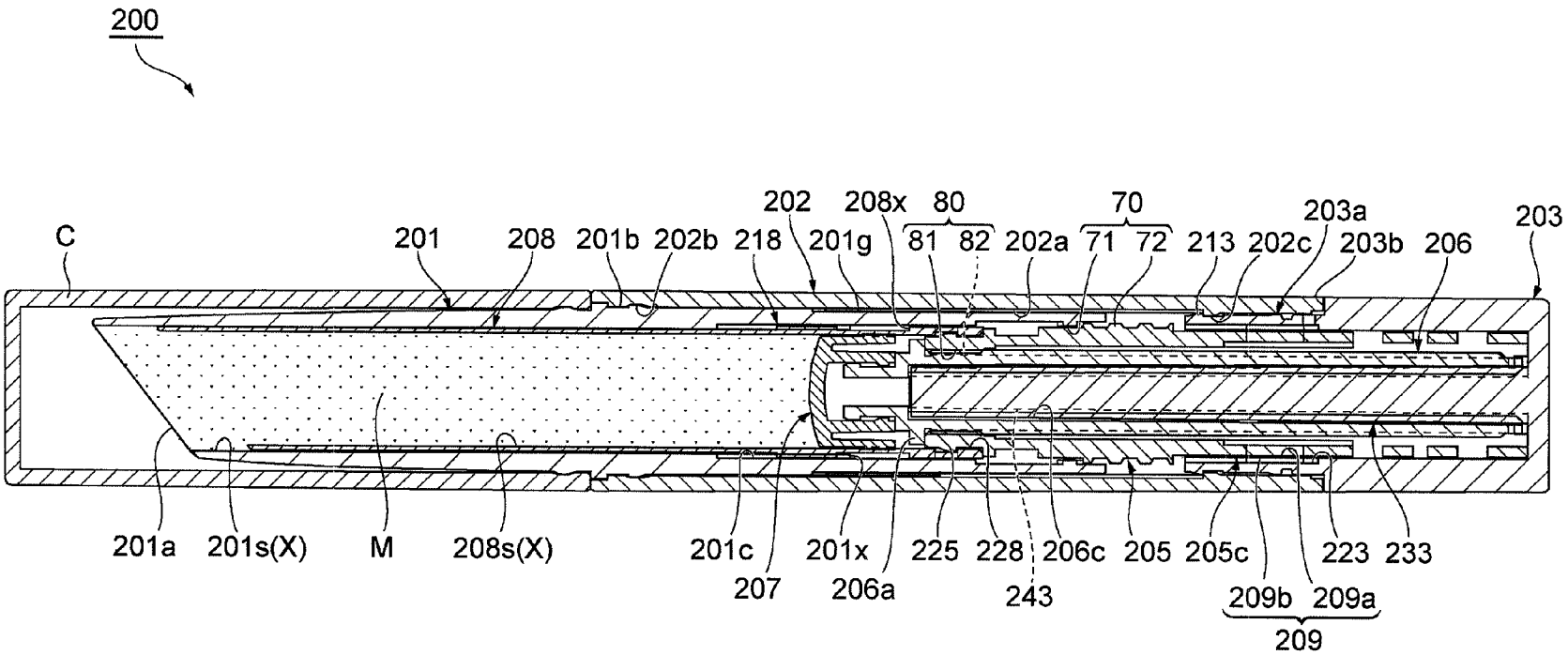
FIG. 14 is a vertical cross-sectional view showing an initial state of an applying material extruding container according to a second embodiment.
Figure 15:
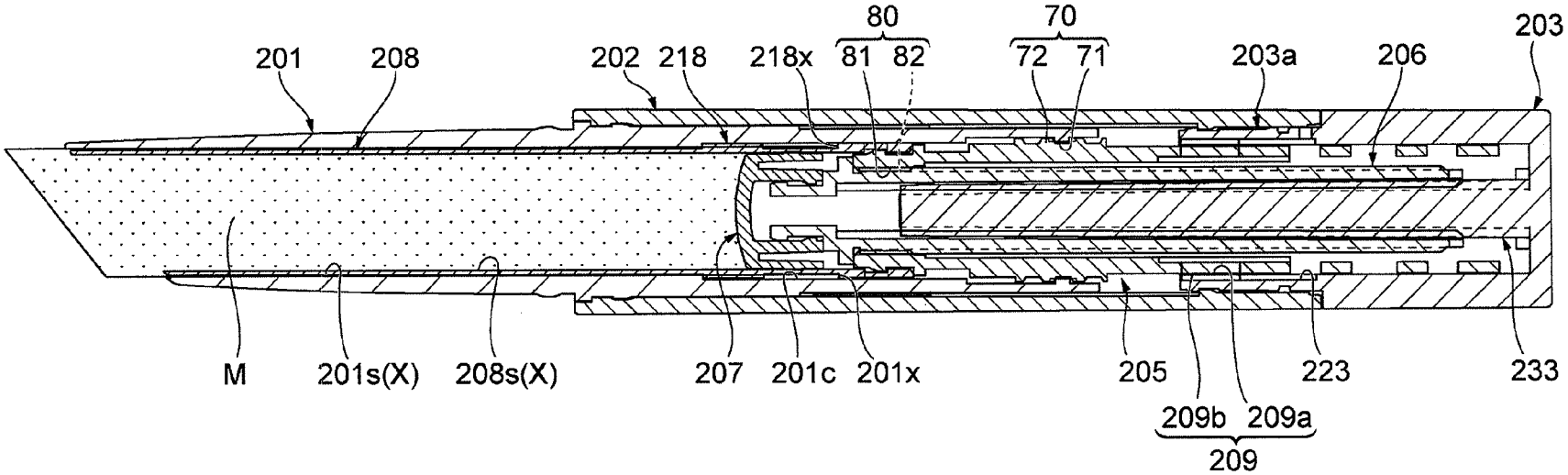
FIG. 15 is a vertical cross-sectional view showing a state of the forward limit of a pipe member in the applying material extruding container of FIG. 14.
Figure 16:
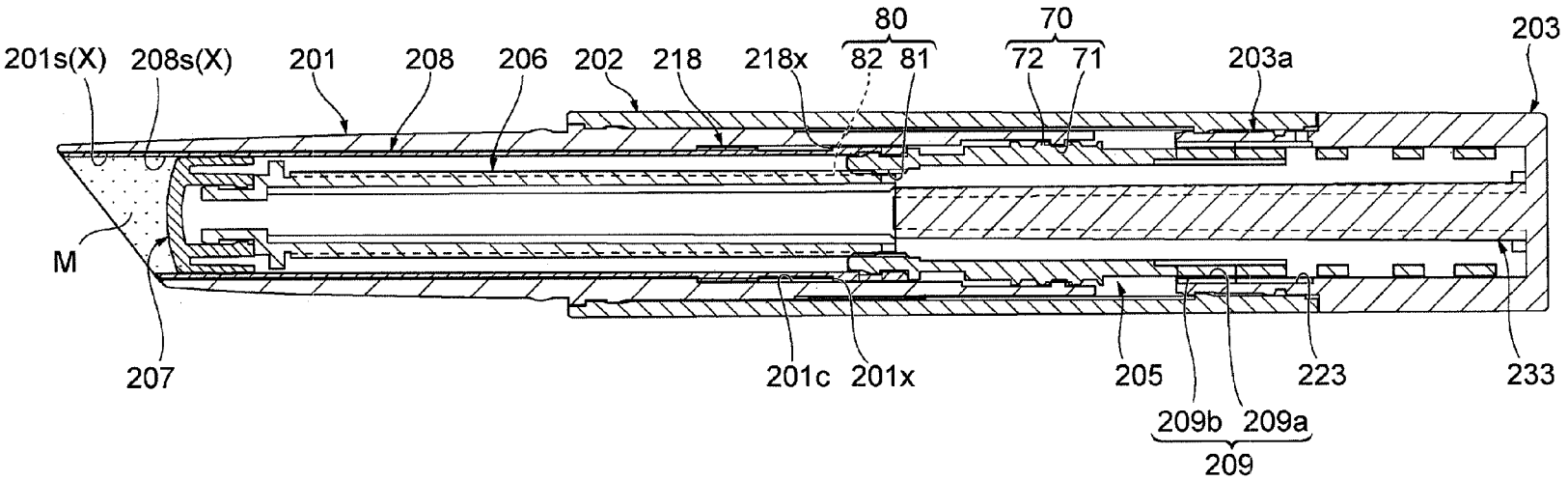
FIG. 16 is a vertical cross-sectional view showing a state of the forward limit of a piston in the applying material extruding container of FIG. 14.

FIG. 14 is a vertical cross-sectional view showing an initial state of an applying material extruding container according to a second embodiment, FIG. 15 is a vertical cross-sectional view showing a state of the forward limit of a pipe member in the applying material extruding container of FIG. 14 and FIG. 16 is a vertical cross-sectional view showing a state of the forward limit of a piston in the applying material extruding container of FIG. 14. As shown in FIG. 14, the applying material extruding container 200 of the present embodiment can hold the applying material M and also extrude and remove the applying material M, as necessary, by an operation of the user.

As the applying material M, the same as the present embodiment, for example, the followings can be used: various rod-shaped cosmetic materials such as a lipstick, a lip gloss, an eyeliner, an eye-color, an eyebrow, a lip-liner, a cheek-color, a concealer, a cosmetic stick and a hair color; a rod-shaped core of a writing instrument or the like; and the like. In particular, rod-shaped members that are very soft (such as semisolid-shaped, soft solid-shaped, soft-shaped, jelly-shaped, mousse-shaped and paste-shaped with these contained) are preferably used. A rod-shaped member whose outside diameter is 1 mm or less or a thick rod-shaped member of 10 mm or more can be used.

The applying material extruding container 200 includes, as an external configuration, a front tube 201 which has, at a top end, a discharge port 201*a* filled with the applying material M, a main body tube 202 in which the front tube 201 is internally inserted into its front portion and which engages the front tube 201 in the axial direction and in the rotation direction and couples it integrally and a control tube 203 which is relatively rotatable coupled, in the axial direction, to the rear end portion of the main body tube 202. The front tube 201 and the main body tube 202 constitute the front portion of the container, and the control tube 203 forms the rear portion of the container.

The applying material extruding container 200 includes, therewithin, a moving screw tube 205, a movable body 206 and a piston 207. The moving screw tube 205 constitutes a screwing member, and screws to the front tube 201 through a first screwing portion 70. The movable body 206 engages with the control tube 203 both synchronously rotatable and movably in the axial direction, and screws to the moving screw tube 205 through a second screwing portion 80. The piston 207 is an extruding portion that is fitted to a front end (top end) of the movable body 206, and constitutes (forms) a rear end of a filling region X by being internally inserted into a pipe member 208 which will be described later so as to be brought into intimate contact with the pipe member 208.

In the present embodiment, the applying material extruding container 200 includes the pipe member 208 that is internally inserted into the front tube 201 slidably in the axial direction and a ratchet mechanism 209 that allows the moving screw tube 205 and the control tube 203 to be relatively rotated only in one direction.

In the applying material extruding container 200, when the main body tube 202 (it is possible to use the front tube 201) and the control tube 203 are relatively rotated in one direction, the moving screw tube 205 is moved forward by the screwing action of the first screwing portion 70, and the pipe member 208 is move forward with respect to the front tube 201 together with the movable body 206 and the piston 207 and furthermore, when they are relatively rotated in one direction, the movable body 206 and the piston 207 are moved forward by the screwing action of the second screwing portion 80 with respect to the front tube 201 and the pipe member 208. When the main body tube 202 and the control tube 203 are relatively rotated in a direction opposite to the one direction, the moving screw tube 205 is moved backward by the screwing action of the first screwing portion 70, and the pipe member 208 is moved backward with respect to the front tube 201 together with the movable body 206 and the piston 207.

The main body tube 202 is molded of, for example, ABS resin (copolymer synthetic resin of acrylonitrile-butadiene-styrene), and is constituted in the shape of a cylinder. The main body tube 202 has, on the inner circumferential surface of the center portion in the axial direction, as a portion for engaging the front tube 201 in the rotation direction, a knurl 202*a* in which a large number of recesses and projections are aligned in the circumferential direction and the recesses and projections extend in the axial direction by a predetermined length. On the inner circumferential surface of the front end portion of the main body tube 202, a ring-shaped concave-convex portion (in which concave-convex portions are aligned in the axial direction) 202*b* for engaging the front tube 201 in the axial direction is provided. On the inner circumferential surface of the main body tube 202 on the rear portion side and on the rear side of the knurl 202*a*, as a portion for engaging the control tube 203 in the axial direction, a convex portion 202*c* that extends along the inner circumferential surface in the circumferential direction is formed.

Figure 17:
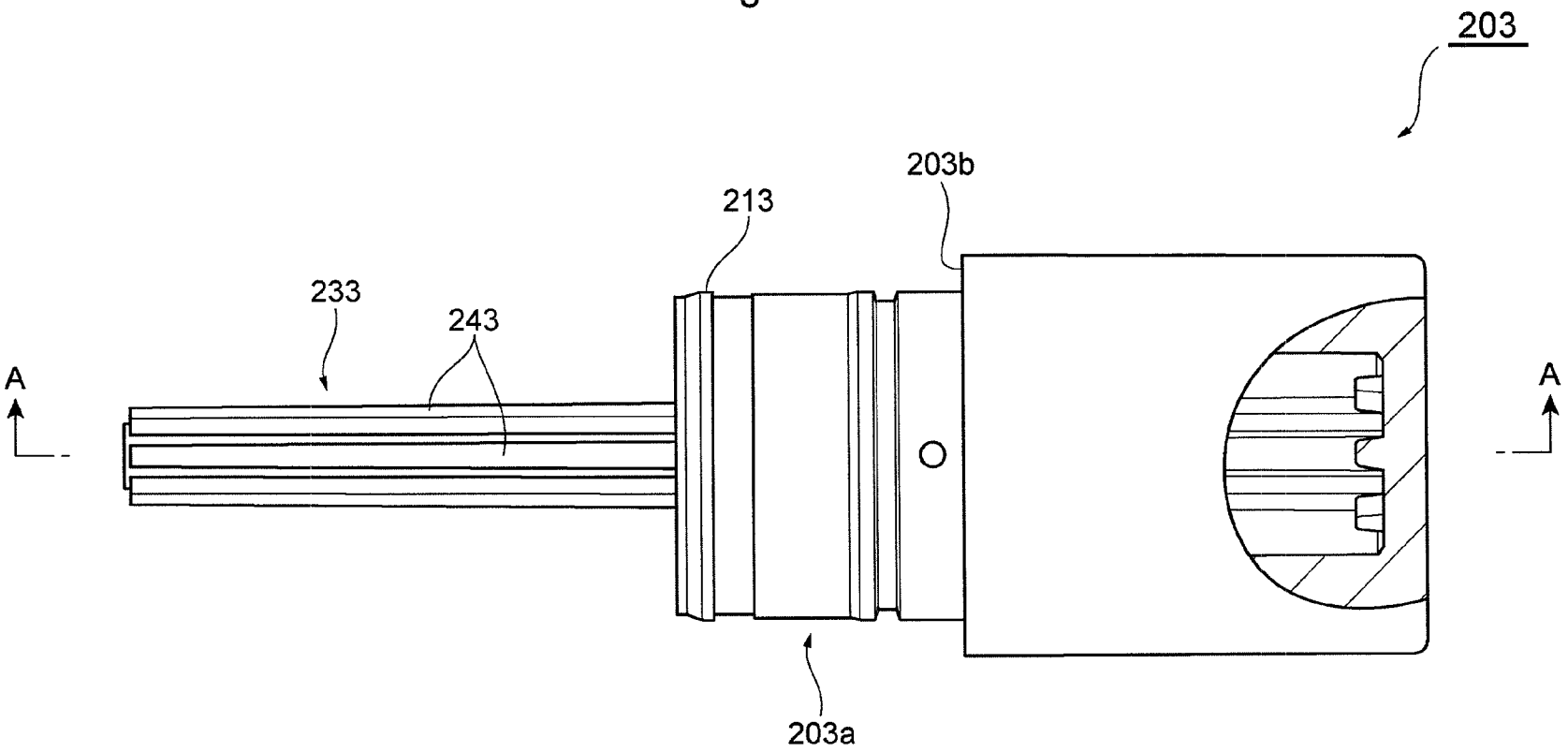
FIG. 17 is a side view showing the control tube of the applying material extruding container of FIG. 14 with its portion shown as a cross section.
Figure 18:
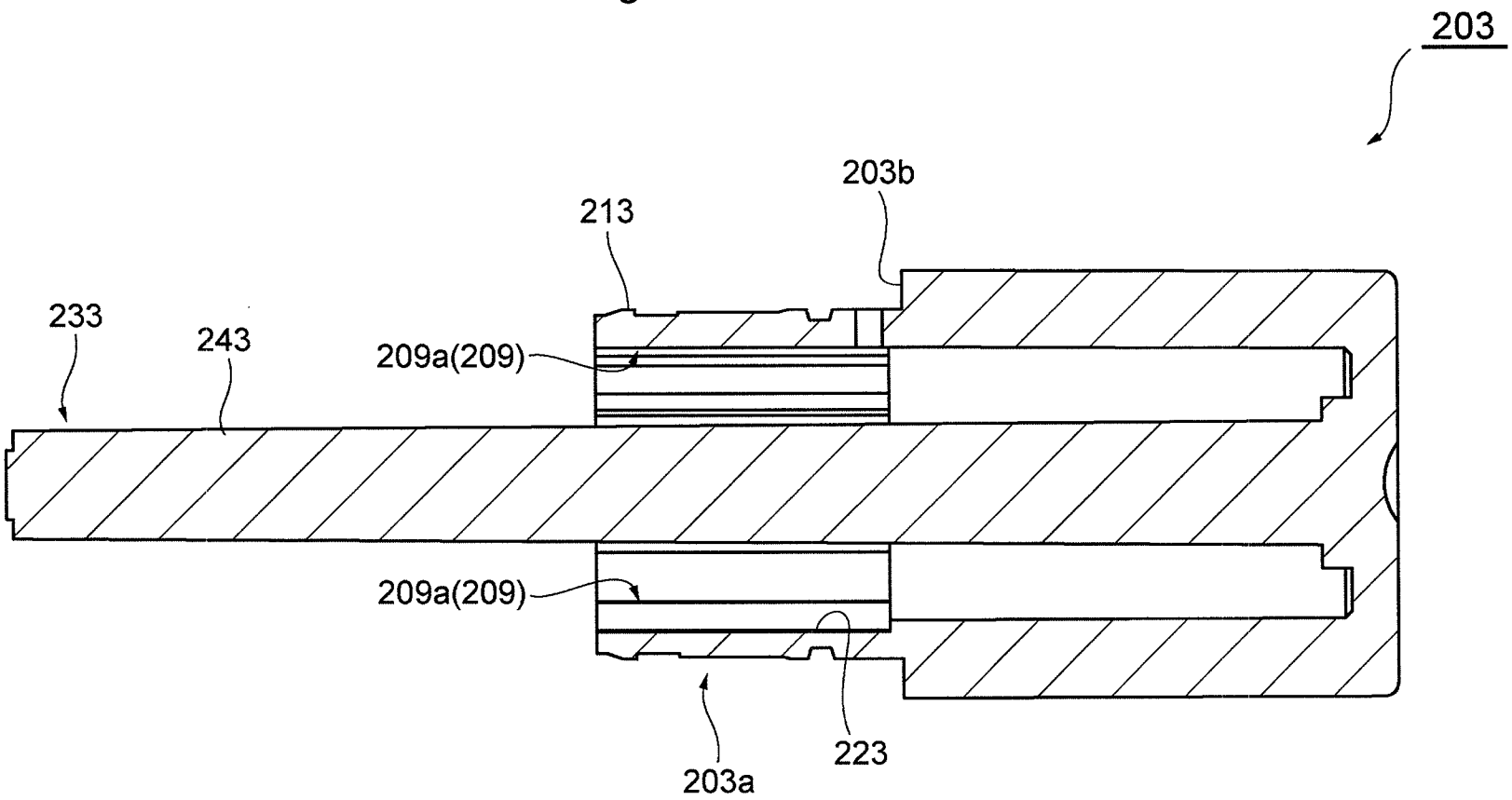
FIG. 18 is a cross-sectional view taken along line A-A of FIG. 17.
Figure 19:
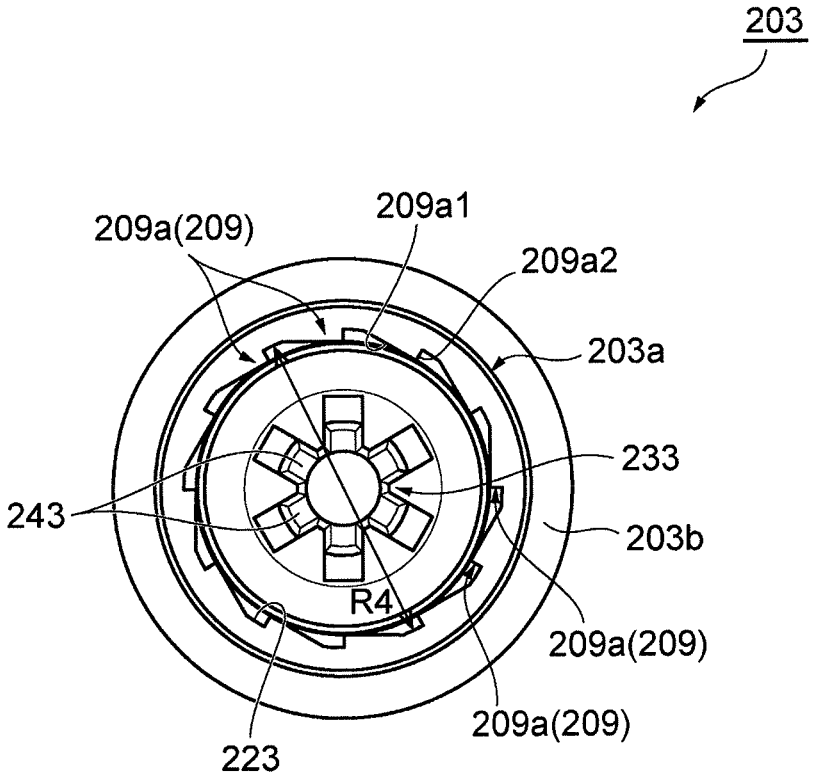
FIG. 19 is a front view showing the control tube of FIG. 17.

FIG. 17 is a side view showing the control tube of the applying material extruding container of FIG. 14 with its portion shown as a cross section, FIG. 18 is a cross-sectional view taken along line A-A of FIG. 17 and FIG. 19 is a front view showing the control tube of FIG. 17. As shown in FIGS. 17 to 19, the control tube 203 is molded of, for example, ABS resin, and is formed in the shape of a cylinder that has an opening in the front and that has a bottom. The front end side of the control tube 203 has, as a portion into which the main body tube 202 is externally inserted, a front end tube portion (second tubular portion) 203*a* whose outside diameter is decreased through a step 203*b*.

At the front portion on the outer circumferential surface of the front end tube portion 203*a*, a ring-shaped convex portion 213 that engages with the main body tube 202 in the axial direction is provided. On the inner circumferential surface 223 of the front end tube portion 203*a*, a plurality of protrusion portions 209*a* on one side that constitute the ratchet teeth of the ratchet mechanism 209 are provided. The protrusion portions 209*a* on one side are provided so as to protrude inwardly in the radial direction at twelve positions evenly spaced in the circumferential direction on the inner circumferential surface 223 of the front end tube portion 203*a*. The protrusion portions 209*a* on one side here are provided so as to have a saw-tooth shape in the circumferential direction. When the moving screw tube 205 is moved forward and backward, the protrusion portions 209*a* on one side extend along the axial direction so as to constantly make contact with protrusion portions 209*b* on the other side which will be described later.

In the protrusion portion 209*a* on one side, a side surface 209*a*1 on one side (the side that makes contact with the protrusion portion 209*b* on the other side to be described later when the main body tube 202 and the control tube 203 are relatively rotated in one direction) in the circumferential direction is inclined with respect to the tangent plane of the inner circumferential surface 223 so as to be formed in the shape of a mountain. In the protrusion portion 209*a* on one side, a side surface 209*a*2 on the other side (the side that makes contact with the protrusion portion 209*b* on the other side to be described later when the main body tube 202 and the control tube 203 are relatively rotated in the other direction) in the circumferential direction is constituted so as to be substantially perpendicular to the tangent plane of the inner circumferential surface 223.

In the center of the bottom portion of the control tube 203, an axial member 233 that engages with the movable body 206 in the rotation direction is provided so as to stand. The axial member 233 is configured to have a non-circular outer shape. Specifically, the axial member 233 has, on the outer circumferential surface of a cylindrical member, protrusions 243 that are arranged so as to protrude externally in the radial direction in six positions evenly spaced in the circumferential direction and that extend in the axial direction, and is formed such that its horizontal cross section is formed in a non-circular shape.

As shown in FIGS. 14 and 17, in the control tube 203, the front end tube portion 203*a* is internally inserted into the main body tube 202, the step 203*b* is brought into contact with the rear end surface of the main body tube 202 and the ring-shaped convex portion 213 engages with the convex portion 202*c* of the main body tube 202 in the axial direction, with the result that the control tube 203 is coupled and fitted to the main body tube 202 relatively and rotatably in the axial direction.

Figure 20A:
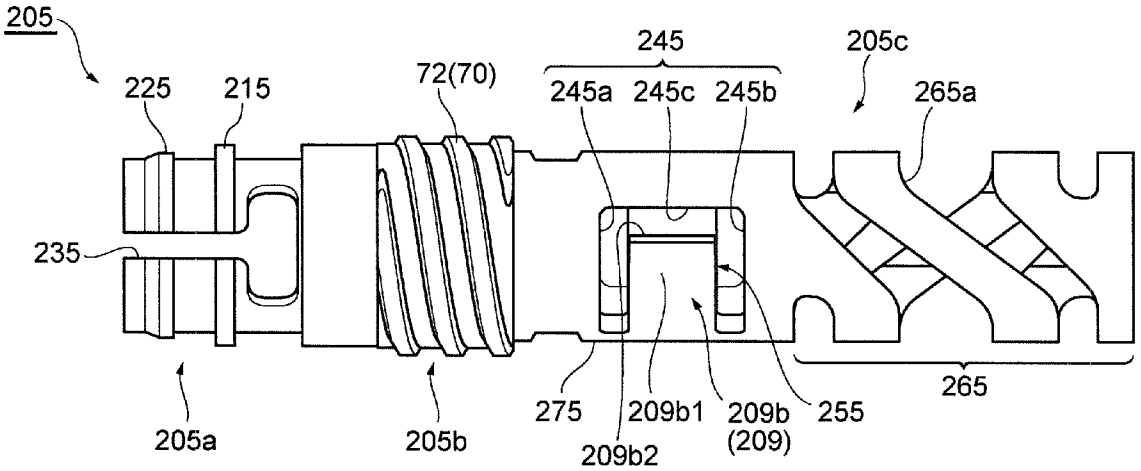
FIG. 20(*a*) is a side view showing a moving screw tube of the applying material extruding container of FIG. 14, and FIG. 20(*b*) is a bottom view showing the moving screw tube of FIG. 20(*a*)
Figure 20B:
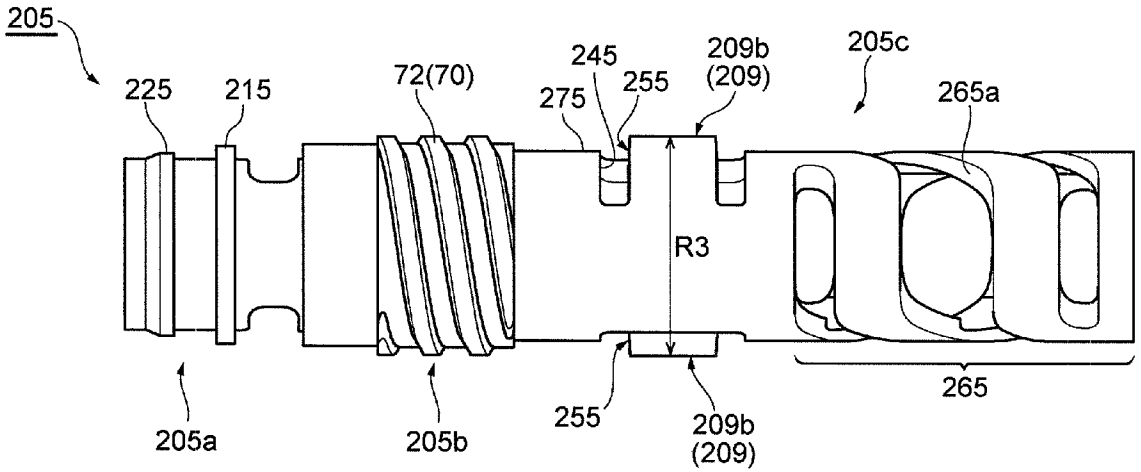
Figure 21:
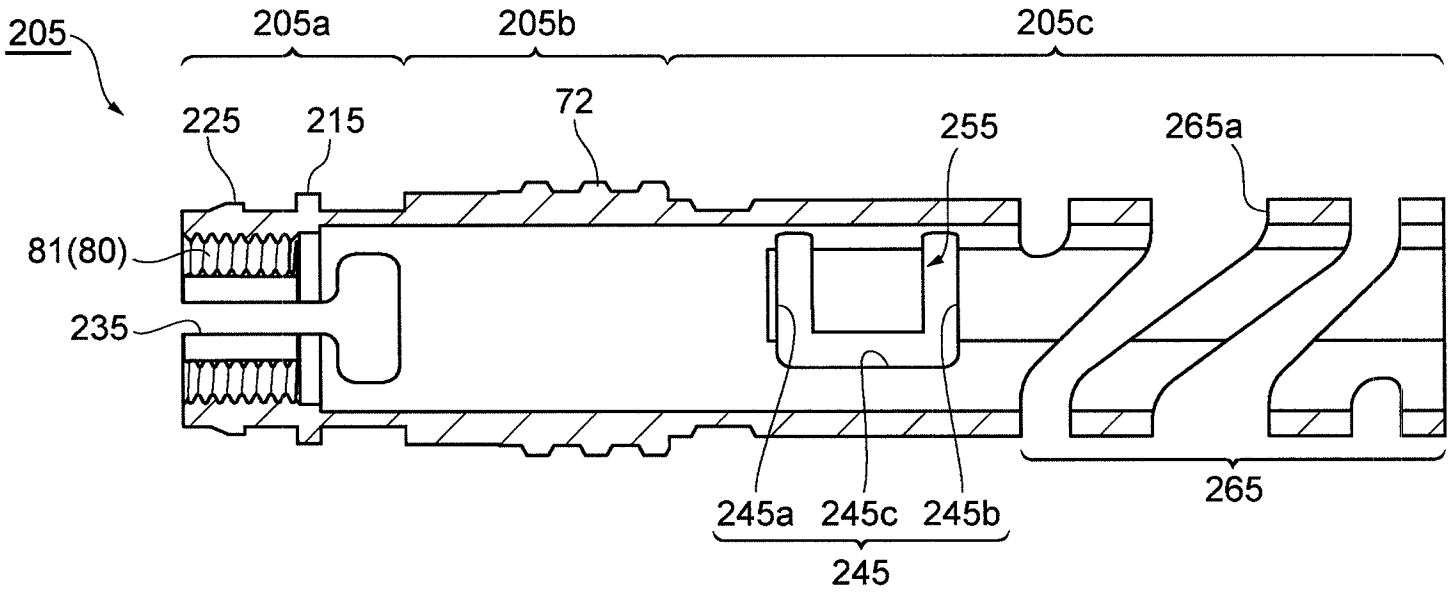
FIG. 21 is a cross-sectional view showing the moving screw tube of FIG. 20(*a*)

FIG. 20 is a side view showing the moving screw tube of the applying material extruding container of FIG. 14, and FIG. 21 is a cross-sectional view showing the moving screw tube of FIG. 20. As shown in FIGS. 20 and 21, the moving screw tube 205 is molded of, for example, POM (polyacetal resin), and is constituted in the shape of a cylinder. The moving screw tube 205 includes a front end portion 205*a* on the front end side, a large diameter portion 205*b* continuous to the rear side of the front end portion 205*a* and a main body portion (first tubular portion) 205*c* continuous to the rear side of the large diameter portion 205*b*.

In the front end portion 205*a*, a female screw 81 constituting the second screwing portion 80 is provided in a region extending backward by a predetermined length from the front end on its inner circumferential surface. The pitch of the second screwing portion 80 is set smaller than that of the first screwing portion 70, and the lead (amount of advancement per revolution in the relative rotation of the main body tube 202 and the control tube 203) of the first screwing portion 70 is set larger than that of the second screwing portion 80.

In the center portion on the outer circumferential surface of the front end portion 205*a*, a ring-shaped brim portion 215 that makes contact with the rear end surface of the pipe member 208 in the axial direction is provided. On the front side of the outer circumferential surface of the front end portion 205*a*, a ring-shaped convex portion 225 that engages with the pipe member 208 in the axial direction is provided. The front end portion 205*a* extends from the front end in the axial direction by a predetermined length, and is configured such that the front end portion 205*a* can be expanded outwardly in the radial direction by slits 235 that are formed as a pair so as to be opposite each other. The rear end side of the slits 235 is expanded so as to be oval in the circumferential direction when seen from the side (see FIG. 20), and thus the front end portion 205*a* is easily expanded so that the mold is easily released at the time of molding and the movable body 206 is easily assembled.

The large diameter portion 205*b* has an outer shape whose diameter is larger than that of the front end portion 205*a*, and is provided, in the moving screw tube 205, close to the front of the center portion in the axial direction. In the large diameter portion 205*b*, a male screw 72 constituting the first screwing portion 70 is provided in a region extending forward by a predetermined length from the rear end on its outer circumferential surface.

The main body portion 205*c* has an outer shape whose diameter is smaller than that of the large diameter portion 205*b*, and is provided, in the moving screw tube 205, in a portion extending from the center portion in the axial direction to the rear end portion. In the main body portion 205*c*, in a pair of positions opposite each other in its outer circumferential surface 275, protrusion portions 209*b* on the other side that constitute the ratchet teeth of the ratchet mechanism 209 are provided. The protrusion portions 209*b* on the other side engage with the protrusion portions 209*a* on one side in the rotation direction (see FIG. 19), and are provided so as to protrude outwardly in the radial direction. In the main body portion 205*c*, around the protrusion portions 209*b* on the other side, cutouts 245 which make the inside and the outside of the moving screw tube 205 communicate with each other and whose cross section is U-shaped are formed, and the protrusion portions 209*b* on the other side become elastic in the radial direction by the cutouts 245.

Specifically, the cutout 245 includes: a pair of slits 245*a* and 245*b* that are provided to be bored on both sides of the protrusion portion 209*b* on the other side in the main body portion 205*c* in the axial direction and that extend in the circumferential direction; and a slit 245*c* that is provided to be bored on one side of the protrusion portion 209*b* on the other side in the main body portion 205*c* on one side in the circumferential direction and that extends along the axial direction so as to be continuous to the slits 245*a* and 245*b*. A wall portion surrounded by the cutout 44 in the main body portion 205*c* forms an arm 255 that is flexible in the radial direction, and thus the protrusion portion 209*b* on the other side arranged on the top end portion of the arm 255 has a predetermined elastic force (applying force) in the radial direction.

In the protrusion portion 209*b* on the other side, a side surface 209*b*1 on the other side (the side that makes contact with the protrusion portion 209*a* on one side when the main body tube 202 and the control tube 203 are relatively rotated in one direction) in the circumferential direction is inclined with respect to the tangent plane of the outer circumferential surface 275 so as to be formed in the shape of a mountain. In the protrusion portion 209*b* on the other side, a side surface 209*b*2 on one side (the side that makes contact with the protrusion portion 209*a* on one side when the main body tube 202 and the control tube 203 are relatively rotated in the other direction) in the circumferential direction is constituted so as to be substantially perpendicular to the tangent plane of the outer circumferential surface 275.

In the rear portion of the main body portion 205*c* with respect to the protrusion portions 209*b* on the other side, a spring portion 265 is provided. The spring portion 265 is a so-called resin spring that can expand and contract in the axial direction, and applies a force to the male screw 72 such that the first screwing portion 70 is subjected to screwing return. The spring portion 265 is provided by forming, in the main body portion 205*c*, a slit 265*a* that extends helically along the outer circumferential surface and that make the inside and the outside communicate with each other.

As shown in FIGS. 14 and 20, the moving screw tube 205 is internally inserted into the main body tube 202 and the control tube 203, and the protrusion portions 209*b* on the other side engage with the protrusion portions 209*a* on one side of the control tube 203 in the rotation direction, with the result that the ratchet mechanism 209 is formed.

Figure 22:
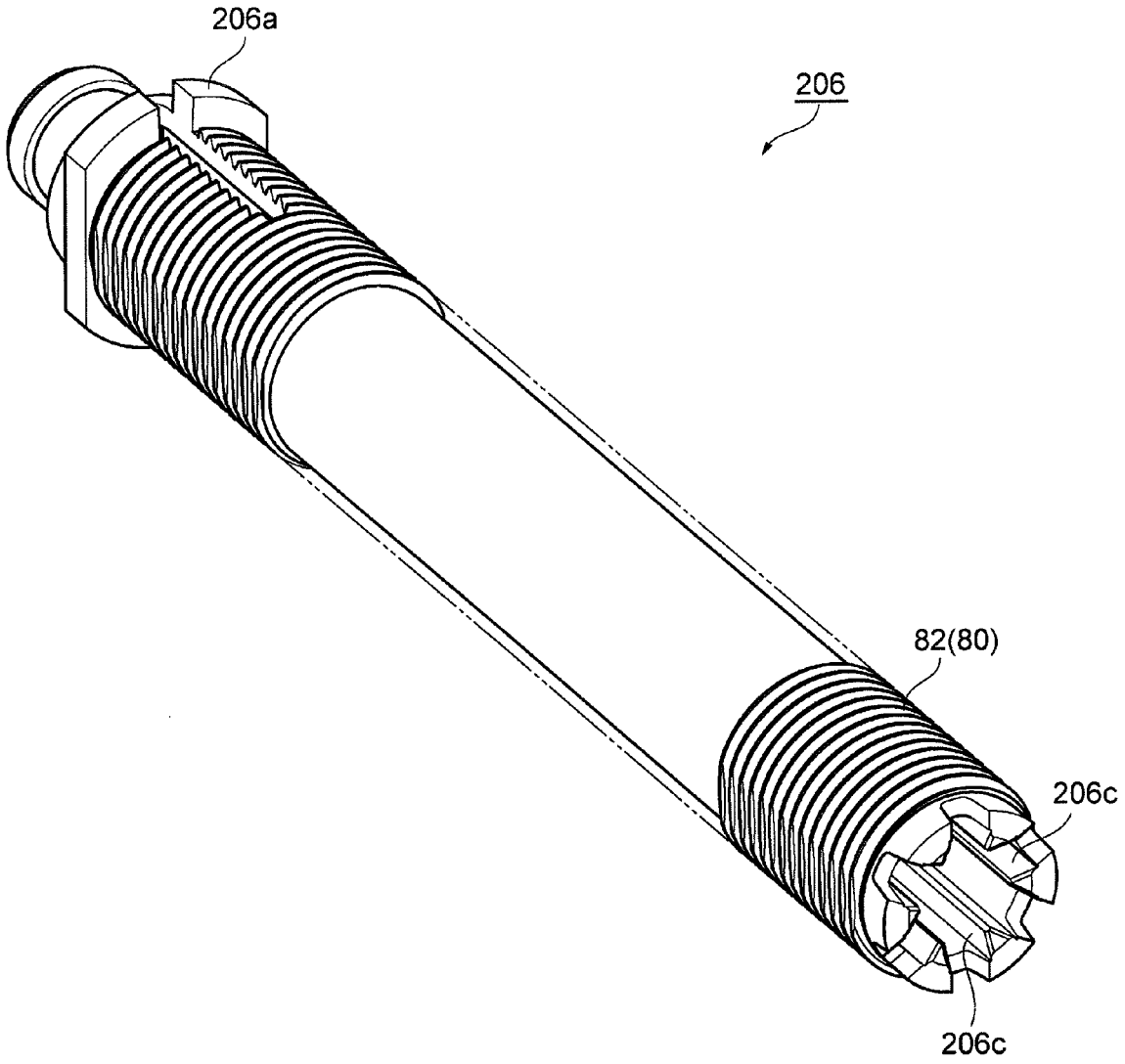
FIG. 22 is a perspective view showing the movable body of the applying material extruding container of FIG. 14.

FIG. 22 is a perspective view showing the movable body of the applying material extruding container of FIG. 1. As shown in FIG. 22, the movable body 206 is molded of, for example, POM, and is constituted in the shape of a cylinder having a brim portion 206*a* on the top end side. The movable body 206 has a male screw 82 of the second screwing portion 80 on the outer circumferential surface extending from the rear side of the brim portion 206*a* to the rear end portion. In six positions evenly spaced in the circumferential direction in the inner circumferential surface of the movable body 206, as portions that engage with the control tube 203 in the rotation direction, protrusions 206*c* that protrude radially and that extend in the axial direction are provided.

As shown in FIGS. 14 and 22, the movable body 206 is externally inserted from its rear end side between the axial member 233 and the moving screw tube 205 of control tube 203. Here, in the movable body 206, the male screw 82 is screwed to the female screw 81 of the moving screw tube 205, and the protrusions 206*c* enter between the protrusions 243 of the axial member 233 and engage in the rotation direction, with the result that the movable body 206 is fitted to the control tube 203 both synchronously rotatably and movably in the axial direction.

Figure 23:
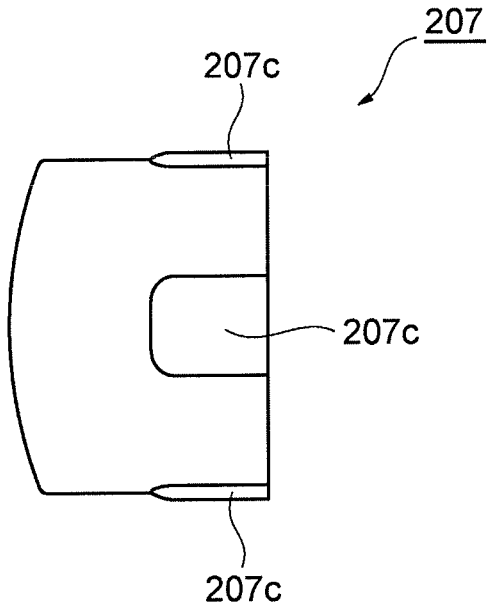
FIG. 23(*a*) is a side view showing the piston of the applying material extruding container of FIG. 14, and FIG. 23(*b*) is a cross-sectional view showing the piston of FIG. 23(*a*)
Figure 23B:
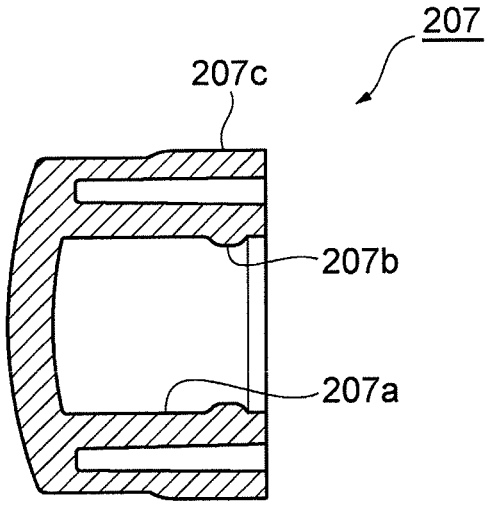

FIG. 23(*a*) is a side view showing the piston of the applying material extruding container of FIG. 14, and FIG. 23(*b*) is a cross-sectional view showing the piston of FIG. 23(*a*). As shown in FIGS. 14 and 23, the piston 207 is molded of, for example, PP (polypropylene), HDPE (high-density polyethylene), LLDPE (linear low-density polyethylene) or the like. In the piston 207, on the inner circumferential surface of a concave portion 207*a* provided in the rear end surface so as to be concave, a ring-shaped protrusion portion 207*b* is provided which engages with the movable body 206 such that the ring-shaped protrusion portion 207*b* can be moved by a predetermined length with respect to the movable body 206 in the axial direction.

In four positions evenly spaced in the circumferential direction on the outer circumferential surface of the piston 207, as regions that make intimate contact with the pipe member 208, convex portions 207*c* are provided. The convex portions 207*c* are portions that make contact (intimate contact) with the pipe member 208 to make it slidable with resistance, and is provided so as to extend from the center portion to the rear end in the axial direction. A small gap (air trap) is formed between the convex portions 207*c* in the circumferential direction and between the convex portion 207*c* and a tube hole 208*s* to be described later of the pipe member 208, and thus it is possible to prevent the applying material M from being naturally moved by environmental changes such as temperature change. The piston 207 is externally inserted into the front end portion of the movable body 206, and the ring-shaped protrusion portion 207*b* engages with the movable body 206 in the axial direction, with the result that the piston 207 is fitted to the movable body 206 both synchronously rotatably and movably in the axial direction (movably within a predetermined range).

Figure 24:
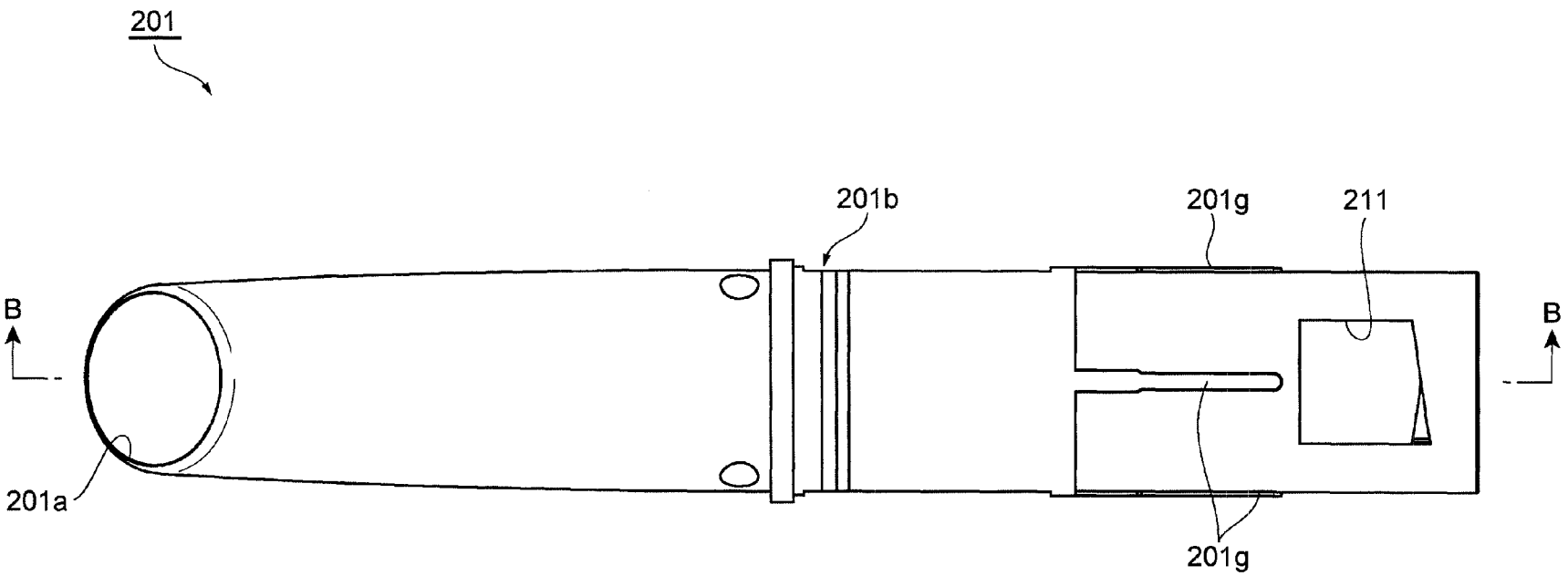
FIG. 24 is a bottom view showing the front tube of the applying material extruding container of FIG. 14.
Figure 25:
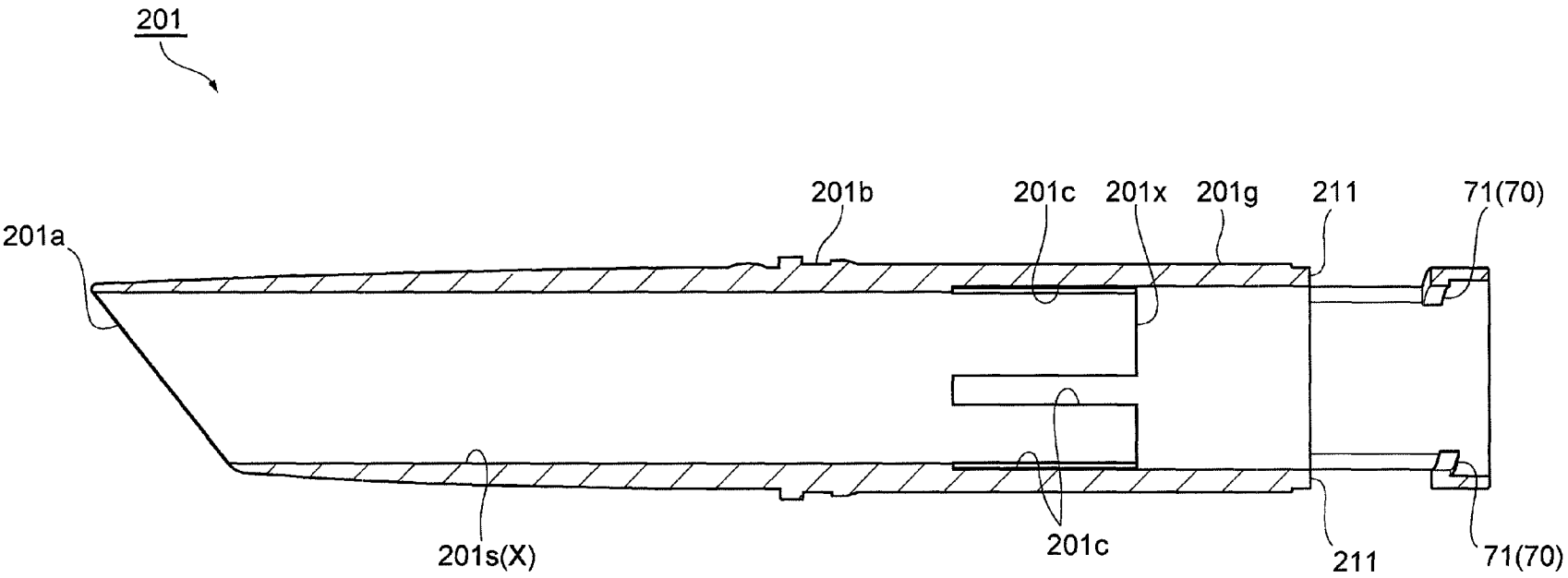
FIG. 25 is a cross-sectional view taken along line B-B of FIG. 24.

FIG. 24 is a bottom view showing the front tube of the applying material extruding container of FIG. 14, and FIG. 25 is a cross-sectional view taken along line B-B of FIG. 24. As shown in FIGS. 24 and 25, the front tube 201 is formed in the shape of a cylinder, and an opening at its front end is the discharge port 201*a* through which the applying material M is discharged. The front tube 201 is molded of, for example, PET (polyethylene terephthalate) resin, ABS resin or the like. The discharge port 201*a* is formed with an inclination angle surface that is inclined at a predetermined angle with respect to the axial direction. The discharge port 201*a* may be formed in a flat shape formed with a vertical surface in the axial direction or may be formed in the shape of a mountain.

In the outer circumferential surface of the front tube 201, a ring-shaped convex-concave portion 201*b* for engaging with the ring-shaped concave-convex portion 202*b* of the main body tube 202 in the axial direction is provided. In four positions evenly spaced in the circumferential direction on the rear side with respect to the ring-shaped convex-concave portion 201*b* in the outer circumferential surface of the front tube 201, protrusions 201*g* extending in the axial direction are provided as portions that engage with the knurl 202*a* of the main body tube 202 in the rotation direction.

In positions close to the rear of the axial center portion in the inner circumferential surface of the front tube 201, as portions that engage with the pipe member 208 in the rotation direction, a plurality of groove portions 201*c* extending in the axial direction are provided. The groove portions 201*c* here are provided in the four positions evenly spaced in the circumferential direction in the inner circumferential surface of the front tube 201 so as to extend. In the rear side with respect to the groove portions 201*c* in the inner circumferential surface of the front tube 201, its diameter is increased through a step 201*x*, and its inside diameter is continuous to the bottom surface of the groove portions 201*c*.

In the rear side with respect to the groove portions 201*g* in the outer circumferential surface of the front tube 201, a pair of openings 211 are formed as through-holes which make the inside and the outside of the front tube 201 communicate with each other such that they are opposite each other. The opening 211 is provided substantially in the shape of a rectangle as seen in the direction in which the openings 211 are opposite each other (see FIG. 24) so as to be bored. Specifically, the opening 211 includes a front end that extends along the circumferential direction, a rear end that extends in a helical direction with respect to the circumferential direction and both-side ends that extend along the axial direction.

The female screws 71 of the first screwing portion 70 are provided so as to be continuous to the rear side of the openings 211 in the inner circumferential surface of the front tube 201. The female screws 71 are protrusions extending helically in the inner circumferential surface of the front tube 201, and are provided as a pair so as to be rotated by 180° with respect to the axial line and be copied in positions in the circumferential direction of the openings 211. Specifically, the front of the female screws 71 is continuous to the openings 211, and the female screws 71 are formed in a range from one side end to the other side end of the openings 211 in the circumferential direction. The helical direction in which the protrusions extend as the female screws 71 corresponds to the helical direction of the rear end of the openings 211.

The front tube 201 having the female screws 71 described above can be molded of resin easily and preferably by utilizing the openings 211. For example, when an upper mold, a lower mold and core pins are assembled together, a pair of predetermined spaces corresponding to the female screws 71 can be provided by a convex portion on the inside of the upper mold in the radial direction, a convex portion on the inside of the lower mold in the radial direction and the core pins. After the molding (that is, the molten resin fills the predetermined spaces and is solidified to form the female screws 71), the upper mold is removed outwardly in the radial direction such that the convex portion of the upper mold is removed from one of the openings 211, the lower mold is removed outwardly in the radial direction such that the convex portion of the lower mold is removed from the other opening 211 and thereafter the core pins can be removed by being made to slide straight in the axial direction.

As shown in FIGS. 14 and 25, the front tube 201 is internally inserted from its rear side into the main body tube 202, the ring-shaped concave-convex portion 202*b* of the main body tube 202 engages with the ring-shaped convex-concave portion 201*b* in the axial direction and the knurl 202*a* of the main body tube 202 engages with the protrusions 201*g* in the rotation direction, with the result that the front tube 201 is integrally engaged with and fitted to the main body tube 202 in the axial direction and the rotation direction. The front tube 201 is externally inserted from the rear side into the moving screw tube 205, and the female screws 71 are screwed to the male screws 72 of the moving screw tube 205.

Figure 26:
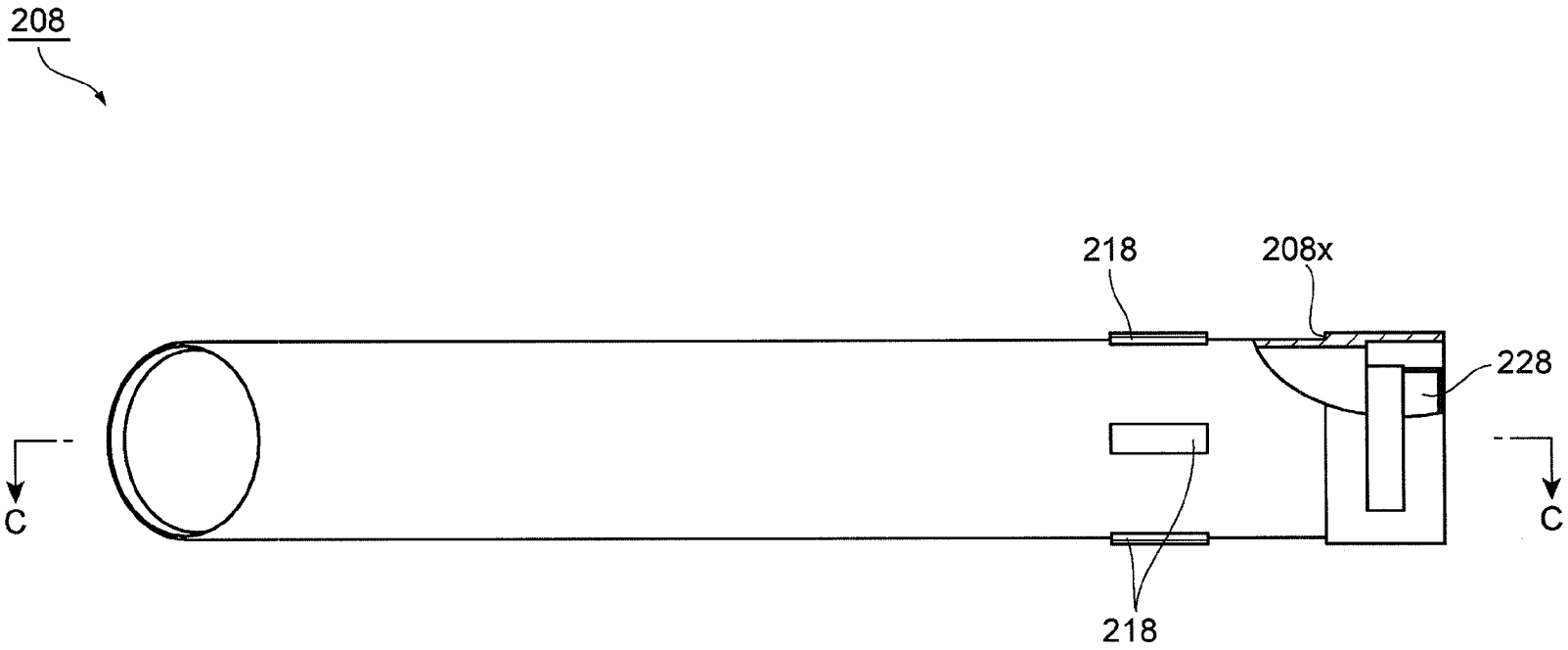
FIG. 26 is a bottom view showing the pipe member of the applying material extruding container of FIG. 14 with its portion shown as a cross section.
Figure 27:
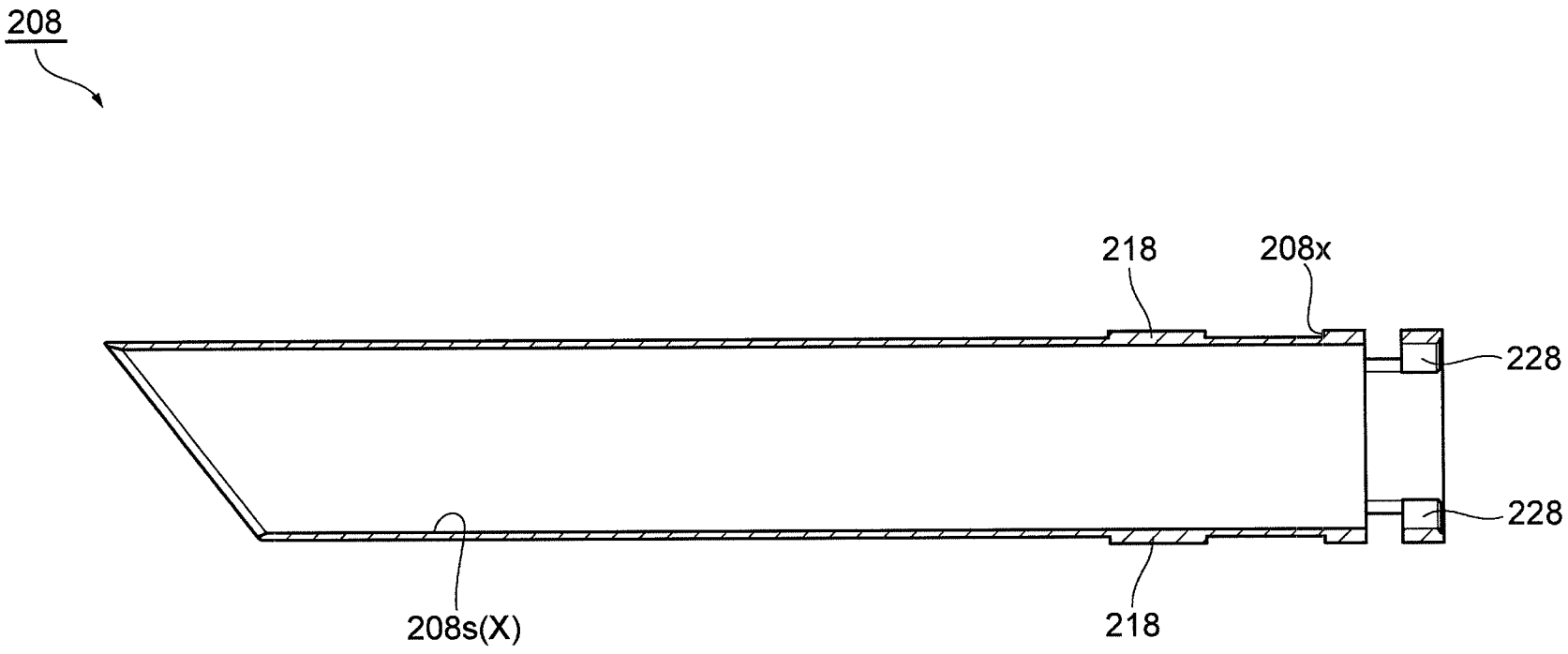
FIG. 27 is a cross-sectional view taken along line C-C of FIG. 26.

FIG. 26 is a bottom view showing the pipe member of the applying material extruding container of FIG. 14 with its portion shown as a cross section, and FIG. 27 is a cross-sectional view taken along line C-C of FIG. 26. As shown in FIGS. 26 and 27, the pipe member 208 is formed in the shape of a cylinder, and as with the discharge port 201*a* (see FIG. 14), the opening at the front end is formed with an inclination angle surface that is inclined at the predetermined angle described above. The pipe member 208 is formed of, for example, PP or the like. The thickness of the pipe member 208 forming the tube hole 208*s* is preferably made constant and minimized, and is, for example, 0.2 to 0.5 mm.

On the rear side of the center portion in the axial direction on the outer circumferential surface of the pipe member 208, as portions that engage with the front tube 201 in the rotation direction, a plurality of protrusions 218 extending in the axial direction are provided. In order to facilitate locating in the circumferential direction at the time of assembly, the protrusions 218 are provided in four positions unevenly arranged in the circumferential direction (here, two positions of the four positions evenly spaced in the circumferential direction are displaced in the circumferential direction). The diameter of the rear end portion on the outer circumferential surface of the pipe member 208 is increased through a step 208*x*. In the rear end portion of the inner circumferential surface of the pipe member 208, as portions that engage with the moving screw tube 205 in the axial direction, a pair of protrusion portions 228 protruding inwardly in the radial direction are provided opposite each other.

As shown in FIGS. 14 and 27, the pipe member 208 is internally inserted into the front tube 201 such that the pipe member 208 can slide with respect to the front tube 201 in the axial direction. Here, the groove portions 201*c* of the front tube 201 are engaged with the protrusions 218 in the rotation direction, and thus the relative rotation of the pipe member 208 with respect to the front tube 201 is regulated. In the initial state, the front end of the pipe member 208 is configured to be located by a predetermined amount as compared with the front end of the front tube 201, and is configured to be located substantially in the same position as the front end of the front tube 201 in the forward limit (see FIG. 15).

The pipe member 208 is externally inserted into the front side of the moving screw tube 205, its rear end surface is brought into contact with the brim portion 206*a* of the moving screw tube 205 and the protrusion portions 228 are engaged with the ring-shaped convex portion 225 of the moving screw tube 205 in the axial direction, with the result that the pipe member 208 is coupled to the moving screw tube 205 in the axial direction. The piston 207 is internally inserted into the pipe member 208 so as to be slidably in contact with the pipe member 208.

Here, in the present embodiment, in the initial state, the applying material M fills a region ranging from the interior of the tube hole 208*s* of the pipe member 208 to the interior of the tube hole 201*s* of the front tube 201 (the applying material M is held without a gap), and in other words, the filling region X filled by the applying material M is constituted with the inner circumferential surface of the front tube 201, the inner circumferential surface of the pipe member 208 and the front surface of the piston 207.

In the tube hole 201*s* of the front tube 201, at least the inner circumferential surface that is the inner surface of the region filled by the applying material M extends straight along the axial direction. Specifically, in the inner circumferential surface of the tube hole 201*s*, the front side region from the front end position of the pipe member 208 in the forward limit (initial state) of the pipe member 208 does not have a step, a corner portion, a concave portion, a recess and the like (hereinafter simply referred to as "a step and the like"), is not inclined with respect to the axial direction and extends straight in parallel to the axial direction. Here, in the region filled by the applying material M, the tube hole 201*s* has a constant circular cross section as seen in the axial direction, and both ends are parallel to the axial direction as seen from the side.

In the present embodiment, as shown in FIGS. 19 and 20, in the state where the front end tube portion 203*a* of the control tube 203 has not been externally inserted into the main body portion 205*c* of the moving screw tube 205 (in the state where the assembly has not been performed), the outside diameter R3 of the top end portion of protrusion portion 209*b* on the other side in the main body portion 205*c* is larger than the inside diameter R4 of the inner circumferential surface 223 of the front end tube portion 203*a*. For example, the outside diameter R3 is set larger than the inside diameter R4 by a predetermined length, and the outside diameter R3 is set at ϕ9.4 mm, and the inside diameter R4 is set 9.0 mm. As shown in FIGS. 14 to 16, in the state where the front end tube portion 203*a* has been internally inserted into the main body portion 205*c* (in the state where the assembly has been performed), the protrusion portions 209*b* on the other side are constantly in contact with the inner circumferential surface 223 of the front end tube portion 203*a*.

An example of the operation of the applying material extruding container 200 will then be described.

For example, in the applying material extruding container 200 in the initial state shown in FIG. 14, the front end of the pipe member 208 is located by a predetermined amount with respect to the front end of the front tube 201, and in this state, the applying material M is in intimate contact with the tube hole 208*s* of the pipe member 208, the tube hole 201*s* of the front tube 201 and the piston 207 and fills them. The front surface of the protrusions 218 of the pipe member 208 and the step 208*x* are located apart to the rear side as compared with the front surface of the groove portions 201*c* of the front tube 201 and the step 201*x*, and the pipe member 208 can be moved forward by a predetermined amount with respect to the front tube 201.

When in the applying material extruding container 200 in the initial state, the cap C is removed by the user, and thus the main body tube 202 and the control tube 203 are relatively rotated in one direction that is the feeding-out direction, the side surface 209*b*1 (see FIG. 20) of the protrusion portion 209*b* on the other side in the moving screw tube 205 makes contact with the side surface 209*a*1 (see FIG. 19) of the protrusion portion 209*a* on one side in the control tube 203, they are engaged with each other in the rotation direction and the control tube 203 and the moving screw tube 205 are synchronously rotated. In this way, the moving screw tube 205 and the front tube 201 are relatively rotated, the screwing action of the first screwing portion 70 constituted with the male screw 72 of the moving screw tube 205 and the female screw 71 of the front tube 201 acts and the moving screw tube 205 is moved forward with respect to the front tube 201.

Consequently, as the moving screw tube 205 is moved forward, the pipe member 208 is moved forward with respect to the front tube 201 together with the movable body 206 and the piston 207, the applying material M is fed out with respect to the front tube 201 (in other words, the pipe member 208 is moved forward with respect to the front tube 201 together with the applying material M) and the applying material M is discharged through the discharge port 201*a*.

Then, as shown in FIG. 15, the relative rotation in one direction is continued, and when the front end of the pipe member 208 is located substantially in the same position as the front end of the front tube 201, the front surface of the protrusions 218 of the pipe member 208 and the step 208*x* are brought into contact with the front surface of the groove portions 201*c* of the front tube 201 and the step 201*x*, the forward movement of the pipe member 208 and the moving screw tube 205 is stopped and the screwing action of the first screwing portion 70 is stopped, with the result that the pipe member 208 and the moving screw tube 205 reach the forward limit.

Then, when the relative rotation in one direction is further continued, a rotation force larger than that before the stop is applied to the control tube 203 and the moving screw tube 205, the protrusion portions 209*b* on the other side slide so as to move up over the protrusion portions 209*a* on one side and the control tube 203 and the moving screw tube 205 are subjected to ratchet rotation (so-called "idling"). Consequently, only the screwing action of the second screwing portion 80 constituted with the male screw 82 of the movable body 206 and the female screw 81 of the moving screw tube 205 acts, and thus within the pipe member 208 at rest, the applying material M is extruded by the piston 207 to be moved forward (in other words, the applying material M is moved forward with respect to the front tube 201 and the pipe member 208). Thereafter, the movable body 206 and the piston 207 reach the forward limit (see FIG. 16).

On the other hand, for example, when in the applying material extruding container 200 after being used, the main body tube 202 and the control tube 203 are relatively rotated in the other direction that is the feeding-back direction, the side surface 209*b*2 (see FIG. 20) of the protrusion portions 209*b* on the other side in the moving screw tube 205 makes contact with the side surface 209*a*2 (see FIG. 19) of the protrusion portions 209*a* on one side in the control tube 203, and is locked (securely locked) in the rotation direction, with the result that the control tube 203 and the moving screw tube 205 are relatively rotated. In this way, the moving screw tube 205 and the front tube 201 are relatively rotated, the screwing action of the first screwing portion 70 acts and the moving screw tube 205 is moved backward with respect to the front tube 201.

Consequently, as the moving screw tube 205 is moved backward, the pipe member 208 is moved backward with respect to the front tube 201 together with the movable body 206 and the piston 207, the applying material M is fed back with respect to the front tube 201 (in other words, the pipe member 208 is moved backward with respect to the front tube 201 together with the applying material M) and the applying material M is embedded into the discharge port 201*a*.

Then, when the relative rotation in the other direction is continued, the male screw 72 of the moving screw tube 205 is unscrewed from the female screw 71 of the front tube 201, and the screwing action of the first screwing portion 70 is cancelled, with the result that the moving screw tube 205 and hence the pipe member 208, the movable body 206 and the piston 207 reach a backward limit. In this state, since a force acting to the forward side is applied to the male screw 72 by an elastic force resulting from the contraction of the spring portion 265 (see FIG. 20), when the relative rotation in the other direction is further continued, a click resulting from the engagement and disengagement of the female screw 71 and the male screw 72 is provided, and the backward limit of the moving screw tube 205 is detected by the user whereas when the relative rotation in one direction is performed, the first screwing portion 70 is immediately returned to screwing.

Here, in the applying material extruding container 200 of the present embodiment, as described above, in the state where the front end tube portion 203*a* of the control tube 203 has not been internally inserted into the main body portion 205*c* of the moving screw tube 205, the outside diameter R3 of the top end of the protrusion portion 209*b* on the other side in the main body portion 205*c* is larger than the inside diameter R4 of the inner circumferential surface 223 of the front end tube portion 203*a* (see FIGS. 19 and 20). Then, in the state where the front end tube portion 203*a* has been internally inserted into the main body portion 205*c*, even while the moving screw tube 205 is moved forward and backward, the protrusion portions 209*b* on the other side having an elastic force in the radial direction are constantly in contact with the inner circumferential surface 223 of the front end tube portion 203*a* such that the protrusion portions 209*b* on the other side engage with the protrusion portions 209*a* on one side in the rotation direction.

Hence, even in the present embodiment, the main body portion 205*c* (moving screw tube 205) is held by the front end tube portion 203*a* (control tube 203), and a resistance can be constantly produced therebetween in the rotation direction, with the result that it is possible to reduce the looseness of the applying material extruding container 200.

In the present embodiment, as described above, since when the main body tube 202 and the control tube 203 are further relatively rotated in one direction, a force acting inwardly in the radial direction is applied to the protrusion portions 209*b* on the other side by the elastic force of the cutouts 245 in the radial direction, the side surface 209*b*1 of the protrusion portions 209*b* on the other side engage with the side surface 209*a*1 of the protrusion portions 209*a* on one side in the rotation direction, and slides so as to move up over, the engagement is cancelled and thereafter the engagement is performed again in the rotation direction. Consequently, each time the protrusion portions 209*a* on one side and the protrusion portions 209*b* on the other side engage and disengage with each other, a click feeling is provided to the user. In this way, the protrusion portions 209*a* on one side and the protrusion portions 209*b* on the other side can be utilized as a clicking mechanism for detecting the further forward movement of the applying material M.

Furthermore, in the present embodiment, as described above, the protrusion portions 209*a* on one side and the protrusion portions 209*b* on the other side can also be utilized as the ratchet mechanism 209 that allows only the relative rotation of the main body tube 202 and the control tube 203 in one direction.

As described above, the applying material M fills the region ranging from the interior of the tube hole 208*s* of the pipe member 208 to the interior of the tube hole 201*s* of the front tube 201, and in the inner circumferential surface of the tube hole 201*s* of the front tube 201, at least the region filled by the applying material M extends straight along the axial direction. Hence, when the pipe member 208 is moved forward with respect to the front tube 201, the filling applying material M is prevented from being collapsed due to the shape of the inner circumferential surface of the tube hole 201*s*, for example, when step or the like is formed in the inner circumferential surface, it is possible to prevent the applying material M from being collapsed by being put into or squeezed from the step and the like. Even if the discharged applying material M is expanded, when the pipe member 208 is moved backward with respect to the front tube 201, it is possible to prevent the applying material M from being collapsed by being put into or squeezed from the step and the like.

Hence, in the present embodiment, even when the pipe member 208 is moved forward and backward with respect to the front tube 201, it is possible to reduce the collapse of the shape of the applying material M. In other words, with respect to the soft applying material M, it is possible to reliably extrude and bring back a constant amount thereof and to protect it.

Normally, at the time of use, a force or bending pivoted on the front end of the pipe member 208 acts on the applying material M that is extruded from the pipe member 208. Hence, in order for the collapse such as the breakage of the applying material M to be reduced, the front end of the pipe member 208 is preferably located forward (the side of the user). On the other hand, when the front end of the pipe member 208 protrudes forward as compared with the front end of the front tube 201, the top end of the pipe member 208 is more likely to make contact with the user, with the result that there is a concern that usability is degraded.

On the other hand, in the present embodiment, as described above, the front end of the pipe member 208 is located, in its forward limit, substantially in the same position as the front end of the front tube 201. Hence, the front end of the pipe member 208 can be located most forward while the front end is unlikely to make contact with the user, with the result that it is possible to enhance the usability and more reduce the collapse of the shape by reducing the breakage of the applying material M and the like.

Incidentally, although in the present embodiment, as described above, the cutouts 245 are formed around the protrusion portions 209*b* on the other side in the main body portion 205*c*, and thus the elastic force is applied to the protrusion portions 209*b* on the other side, either instead of or in addition to this, an elastic force may be applied to the protrusion portions 209*a* on one side by forming cutouts around the protrusion portions 209*a* on one side in the front end tube portion 203*a*.

Preferably, in the present embodiment, in the state where the front end tube portion 203*a* of the second tubular portion has not been externally inserted into the main body portion 205*c* of the first tubular portion, the inside diameter of the top end portion of the protrusion portion 209*a* on one side is smaller than the outside diameter of the outer circumferential surface 275 of the main body portion 205*c* whereas in the state where the front end tube portion 203*a* has been externally inserted into the main body portion 205*c*, the protrusion portions 209*a* on one side are constantly in contact with the outer circumferential surface 275.

Although the preferred embodiments of the present invention have been described above, the present invention is not limited to the embodiments described above, and variations may be made without departing from the outline of claims or applications to other items may be performed.

For example, the applying material M is naturally applicable to a lip gloss, a lip, an eye-color, an eye liner, a cosmetic solution, a cleaning solution, a nail enamel, a nail care solution, a nail remover, a mascara, an anti-aging, a hair color, hair cosmetics, oral care, a massage oil, a keratin plug loosening solution, a foundation, a concealer, a skin cream, the ink of a writing instrument such as a marking pen, a liquid drug and an applying material extruding container using a liquid applying material such as a mud-like material.

Although in the first embodiment, the front end surface has the extruding portion 32 formed in the shape of a flat surface, the extruding portion may be formed in the shape of a bell that is tapered toward the front or the extruding portions in various shapes may be provided.

In the second embodiment, when the main body tube 202 and the control tube 203 are relatively rotated in one direction, the pipe member 208 may be moved forward with respect to the front tube 201 together with the applying material M by the cooperative screwing actions of the first and the second screwing portions 70 and 80, and likewise, when they are relatively rotated in the other direction, the pipe member 208 may be moved backward with respect to the front tube 201 together with the applying material M by the cooperative screwing actions of the first and the second screwing portions 70 and 80. Although in the second embodiment, the first and the second screwing portions 70 and 80 are provided, only one screwing portion may be provided so as to extrude/bring back the applying material M.

In the above description, the "cancellation of the screwing action" means that the threads of the male screw and the female screw are disengaged, and thus the screwing action does not work, and the "stop of the screwing action" means that in a state where the threads of the male screw and the female screw engage and mesh with each other, they are brought into contact, and thus the screwing action does not work. The "return to screwing" means a stage in which the male screw is returned to make contact with the side surface of the thread of the female screw.

The "substantially the same position" in the front end of the pipe member 208 and the front end of the front tube 201 includes not only completely the same position but also substantially equal position and errors in design, manufacturing and assembly. For example, the front end of the pipe member 208 may be located slightly forward or backward with respect to the front end of the front tube 201.

The male screw and the female screw described above may be either screw threads and screw grooves or portions that work like screw threads and screw grooves, such as protrusion groups intermittently arranged or protrusion groups helically or intermittently arranged. Although the shape of the cross section of the applying material M is the inside diameter shape of the cross section of the tube hole 201*s* of the front tube 201 or the tube hole 208*s* of the pipe member 208, not only a circular cross section but also the shapes of various non-circular cross sections such as an oval, a track shape and a polygon whose vertex is rounded and a drop shape can be selected. The present invention can be regarded as a method of manufacturing (molding) the applying material extruding container 100 or 200.

What is claimed is:

1. An applying material extruding container in which a movable body and a screwing member are provided in a container including a front portion of the container and a rear portion of the container, the front portion of the container and the rear portion of the container are relatively rotated in one direction such that screwing actions of screwing portions of the movable body and the screwing member act to move the movable body forward, wherein the screwing member includes a first tubular portion, the rear portion of the container includes a second tubular portion inserted into the first tubular portion, on an outer surface of the second tubular portion, a protrusion portion on one side that protrudes outwardly in a radial direction is provided, on an inner surface of the first tubular portion, a protrusion portion on the other side that protrudes inwardly in the radial direction and that engages with the protrusion portion on one side in a rotation direction is provided, at least one of the protrusion portion on one side and the protrusion portion on the other side has elasticity in the radial direction by cutouts formed therearound and in a state where the second tubular portion has not been inserted into the first tubular portion, an outside diameter of a top end portion of the protrusion portion on one side is larger than an inside diameter of the inner surface of the first tubular portion on which the protrusion portion on the other side is formed, whereas in a state where the second tubular portion has been inserted into the first tubular portion, the protrusion portion on one side is constantly in contact with the inner surface of the first tubular portion or in the state where the second tubular portion has not been inserted into the first tubular portion, an inside diameter of a top end portion of the protrusion portion on the other side is smaller than an outside diameter of the outer surface of the second tubular portion on which the protrusion portion on the one side is formed, whereas in the state where the second tubular portion has been inserted into the first tubular portion, the protrusion portion on the other side is constantly in contact with the outer surface of the second tubular portion.

2. The applying material extruding container of claim 1, wherein the protrusion portion on one side and the protrusion portion on the other side constitute a click mechanism that produces a click feeling as the front portion of the container and the rear portion of the container are relatively rotated.

3. The applying material extruding container of claim 2, wherein the protrusion portion on one side and the protrusion portion on the other side constitute a ratchet mechanism that allows only relative rotation of the front portion of the container and the rear portion of the container in one direction.

4. The applying material extruding container of claim 3, wherein the rear portion of the container is formed in a shape of a cylinder having a bottom, and in a bottom portion thereof, a plurality of opening portions arranged along a circumferential direction are provided, on an inner surface of the rear portion of the container, a plurality of protrusions are provided that protrude inwardly in the radial direction and that engage with the front portion of the container in an axial direction and the protrusions have a positional relationship in which the protrusions respectively cover the opening portions when seen in the axial direction.

5. The applying material extruding container of claim 2, wherein the rear portion of the container is formed in a shape of a cylinder having a bottom, and in a bottom portion thereof, a plurality of opening portions arranged along a circumferential direction are provided, on an inner surface of the rear portion of the container, a plurality of protrusions are provided that protrude inwardly in the radial direction and that engage with the front portion of the container in an axial direction and the protrusions have a positional relationship in which the protrusions respectively cover the opening portions when seen in the axial direction.

6. The applying material extruding container of claim 1, wherein the protrusion portion on one side and the protrusion portion on the other side constitute a ratchet mechanism that allows only relative rotation of the front portion of the container and the rear portion of the container in one direction.

7. The applying material extruding container of claim 6, wherein the rear portion of the container is formed in a shape of a cylinder having a bottom, and in a bottom portion thereof, a plurality of opening portions arranged along a circumferential direction are provided, on an inner surface of the rear portion of the container, a plurality of protrusions are provided that protrude inwardly in the radial direction and that engage with the front portion of the container in an axial direction and the protrusions have a positional relationship in which the protrusions respectively cover the opening portions when seen in the axial direction.

8. The applying material extruding container of claim 1, wherein the rear portion of the container is formed in a shape of a cylinder having a bottom, and in a bottom portion thereof, a plurality of opening portions arranged along a circumferential direction are provided, on an inner surface of the rear portion of the container, a plurality of protrusions are provided that protrude inwardly in the radial direction and that engage with the front portion of the container in an axial direction and the protrusions have a positional relationship in which the protrusions respectively cover the opening portions when seen in the axial direction.

9. An applying material extruding container in which a movable body and a screwing member are provided in a container including a front portion of the container and a rear portion of the container, the front portion of the container and the rear portion of the container are relatively rotated in one direction such that screwing actions of screwing portions of the movable body and the screwing member act to move the movable body forward, wherein the screwing member includes a first tubular portion, the rear portion of the container includes a second tubular portion, wherein the first tubular portion is inserted into the second tubular portion, on an inner surface of the second tubular portion, a protrusion portion on one side that protrudes inwardly in a radial direction is provided, on an outer surface of the first tubular portion, a protrusion portion on the other side that protrudes outwardly in the radial direction and that engages with the protrusion portion on one side in a rotation direction is provided, at least one of the protrusion portion on one side and the protrusion portion on the other side has elasticity in the radial direction by cutouts formed therearound and in a state where the second tubular portion has not had the first tubular portion inserted therein, an outside diameter of a top end portion of the protrusion portion on the other side is larger than an inside diameter of the inner surface of the second tubular portion on which the protrusion portion on the one side is formed, whereas in a state where the second tubular portion has the first tubular portion inserted therein, the protrusion portion on the other side is constantly in contact with the inner surface of the second tubular portion or in the state where the second tubular portion has not had the first tubular portion inserted therein, an inside diameter of a top end portion of the protrusion portion on one side is smaller than an outside diameter of the outer surface of the first tubular portion on which the protrusion portion on the other side is formed, whereas in the state where the second tubular portion has the first tubular portion inserted therein, the protrusion portion on one side is constantly in contact with the outer surface of the first tubular portion.

10. The applying material extruding container of claim 9, wherein the protrusion portion on one side and the protrusion portion on the other side constitute a click mechanism that produces a click feeling as the front portion of the container and the rear portion of the container are relatively rotated.

11. The applying material extruding container of claim 10, wherein the protrusion portion on one side and the protrusion portion on the other side constitute a ratchet mechanism that allows only relative rotation of the front portion of the container and the rear portion of the container in one direction.

12. The applying material extruding container of claim 11, wherein the rear portion of the container is formed in a shape of a cylinder having a bottom, and in a bottom portion thereof, a plurality of opening portions arranged along a circumferential direction are provided, on an inner surface of the rear portion of the container, a plurality of protrusions are provided that protrude inwardly in the radial direction and that engage with the front portion of the container in an axial direction and the protrusions have a positional relationship in which the protrusions respectively cover the opening portions when seen in the axial direction.

13. The applying material extruding container of claim 10, wherein the rear portion of the container is formed in a shape of a cylinder having a bottom, and in a bottom portion thereof, a plurality of opening portions arranged along a circumferential direction are provided, on an inner surface of the rear portion of the container, a plurality of protrusions are provided that protrude inwardly in the radial direction and that engage with the front portion of the container in an axial direction and the protrusions have a positional relationship in which the protrusions respectively cover the opening portions when seen in the axial direction.

14. The applying material extruding container of claim 9, wherein the protrusion portion on one side and the protrusion portion on the other side constitute a ratchet mechanism that allows only relative rotation of the front portion of the container and the rear portion of the container in one direction.

15. The applying material extruding container of claim 14, wherein the rear portion of the container is formed in a shape of a cylinder having a bottom, and in a bottom portion thereof, a plurality of opening portions arranged along a circumferential direction are provided, on an inner surface of the rear portion of the container, a plurality of protrusions are provided that protrude inwardly in the radial direction and that engage with the front portion of the container in an axial direction and the protrusions have a positional relationship in which the protrusions respectively cover the opening portions when seen in the axial direction.

16. The applying material extruding container of claim 9, wherein the rear portion of the container is formed in a shape of a cylinder having a bottom, and in a bottom portion thereof, a plurality of opening portions arranged along a circumferential direction are provided, on an inner surface of the rear portion of the container, a plurality of protrusions are provided that protrude inwardly in the radial direction and that engage with the front portion of the container in an axial direction and the protrusions have a positional relationship in which the protrusions respectively cover the opening portions when seen in the axial direction.

* * * * *